US011253865B2

(12) United States Patent
Doppstadt

(10) Patent No.: US 11,253,865 B2
(45) Date of Patent: Feb. 22, 2022

(54) COMMINUTING DEVICE

(71) Applicant: Doppstadt Familienholding GmbH, Velbert (DE)

(72) Inventor: Ferdinand Doppstadt, Velbert (DE)

(73) Assignee: Doppstadt Familienholding GmbH, Velbert (DE)

( * ) Notice: Subject to any disclaimer, the term of this patent is extended or adjusted under 35 U.S.C. 154(b) by 225 days.

(21) Appl. No.: 16/619,049

(22) PCT Filed: Jun. 6, 2018

(86) PCT No.: PCT/EP2018/064840
§ 371 (c)(1),
(2) Date: Dec. 3, 2019

(87) PCT Pub. No.: WO2019/001916
PCT Pub. Date: Jan. 3, 2019

(65) Prior Publication Data

US 2020/0129988 A1 Apr. 30, 2020

(30) Foreign Application Priority Data

Jun. 28, 2017 (DE) ..... 10 2017 006 098.3

(51) Int. Cl.
*B02C 18/18* (2006.01)
*B02C 18/14* (2006.01)

(52) U.S. Cl.
CPC ..... *B02C 18/145* (2013.01); *B02C 18/18* (2013.01); *B02C 2018/188* (2013.01)

(58) Field of Classification Search
CPC . B02C 2018/188; B02C 18/145; B02C 18/18; B02C 13/09
See application file for complete search history.

(56) References Cited

U.S. PATENT DOCUMENTS 2,261,090 A * 10/1941 Lind ..... B02C 18/18 241/82
4,002,302 A * 1/1977 Miller ..... B02C 13/282 241/89

(Continued)

FOREIGN PATENT DOCUMENTS

DE 29809078 U1 7/1998
DE 29910772 U1 11/1999

(Continued)

OTHER PUBLICATIONS

International Search Report for International Application No. PCT/EP2018/064840, dated Oct. 8, 2018.

(Continued)

*Primary Examiner* — Faye Francis
(74) *Attorney, Agent, or Firm* — Jason H. Vick; Sheridan Ross, PC

(57) ABSTRACT

An exemplary aspect encompasses a comminution apparatus for comminution of material to be comminuted which includes a machine frame, a driven comminution roller which is mounted on the machine frame and comminution tools. A comb including counter tools and a comb flap is pivotably mounted on the machine frame, wherein the comminution roller cooperates with the comb for comminution, wherein the comb is pivotably mounted on the comb flap in the range of its upper end, wherein at least one spring means engages the comb with its first end and wherein the comb is resiliently supported via the spring means. In accordance with one aspect the spring means is supported by its second end on the machine frame.

20 Claims, 18 Drawing Sheets

(56) References Cited

U.S. PATENT DOCUMENTS 4,385,732 A * 5/1983 Williams ..... B02C 18/0084 241/236
4,557,421 A * 12/1985 Probst ..... B02C 13/284 241/285.3
4,836,457 A * 6/1989 Greiner ..... B02C 13/284 241/73
5,215,269 A * 6/1993 Pozzato ..... B02C 13/1835 241/275
5,472,147 A * 12/1995 Doppstadt ..... B02C 13/09 241/101.74
5,906,322 A * 5/1999 Hama ..... B02C 18/14 241/152.2
7,048,215 B2 * 5/2006 Irwin ..... B02C 18/142 241/236
7,222,805 B1 * 5/2007 Williams, Jr. ..... B02C 13/284 241/32
7,232,084 B2 * 6/2007 Peterson ..... B02C 13/286 241/73
7,832,670 B2 * 11/2010 Peterson ..... B02C 13/31 241/291
8,033,487 B2 * 10/2011 Yamashita ..... B02C 18/146 241/73
9,573,137 B2 * 2/2017 Van der Galien ..... B02C 23/16
10,010,028 B1 * 7/2018 Dilts ..... A01F 29/095
2003/0075628 A1 * 4/2003 Pretzier ..... B02C 18/16 241/243
2009/0121058 A1 * 5/2009 Doppstadt ..... B02C 18/145 241/88.2
2009/0145812 A1 * 6/2009 Doppstadt ..... B02C 18/18 209/10
2010/0252670 A1 * 10/2010 Kitaguchi ..... B02C 18/145 241/277
2015/0217299 A1 * 8/2015 Doppstadt ..... B02C 18/20 241/87.1
2017/0361331 A1 * 12/2017 Doppstadt ..... B02C 18/2216
2020/0129988 A1 * 4/2020 Doppstadt ..... B02C 18/145

FOREIGN PATENT DOCUMENTS

DE 202012007418 U1 11/2013
EP 1050340 A1 11/2000

OTHER PUBLICATIONS

Written Opinion for International Application No. PCT/EP2018/064840, dated Oct. 8, 2018.
International Preliminary Report on Patentability for International Application No. PCT/EP2018/064840, dated Jan. 9, 2020.

* cited by examiner

COMMINUTING DEVICE

CROSS REFERENCE TO RELATED APPLICATIONS

This application is a national stage application under 35 U.S.C. 371 of PCT Application No. PCT/EP2018/064840 having an international filing date of 6 Jun. 2018, which designated the United States, which PCT application claimed the benefit of German Application No. 10 2017 006 098.3, filed 28 Jun. 2017, each of which are incorporated herein by reference in their entirety.

The invention concerns a comminution device or apparatus for comminution of material to be comminuted, comprising a machine frame, a driven comminution roller which is mounted on the machine frame and comprises comminution tools, a comb comprising counter tools and a comb flap pivotably mounted on the machine frame, wherein the comminution roller cooperates with the comb for comminution, wherein the comb is pivotably mounted on the comb flap in the range of its upper end, wherein at least one spring means engages the comb with its first end and wherein the comb is resiliently supported via the spring means.

Such apparatuses, which are usually used for the comminution of feed material, in particular of bedrocks, preferably in the waste and recycling sector, are already known in the state of the art and usually have at least one rotatably driven comminution roller. Individual tools and/or comminution tools, in particular teeth, cutting edges and/or movable hammers, are provided on the cylindrical shell of the comminution roller, i.e. on the roller body. For comminution of the material to be comminuted, these comminution tools interact with the counter tools of the comb, wherein the counter tools of the comb are designed in such a way that the material to be comminuted is comminuted when the comminution roller rotates. The comb is usually designed as a comb beam for holding the tools and usually extends over at least the entire width of the comminution roller. The comb can be designed as a single or multi-piece unit.

At regular intervals it is necessary to replace worn and/or damaged tools of the comb in order to guarantee the desired comminution result. The comb as a whole can be dismantled with the counter tools and exchanged for an already prepared comb with "new" counter tools, so that a replacement of worn and/or overloaded, mostly damaged counter tools is possible in a time-saving way.

In order to adjust the grain size and/or comminution size of the feed material and to achieve optimum interaction between the comb and the comminution roller, the comb, also known as the comb beam, can be adjusted both in terms of its distance from the comminution roller, especially radially to the comminution roller, and in terms of its inclination about its longitudinal axis, so that the best possible adaptation to the process task can be achieved.

In other embodiments, the comb is designed in such a way that it can escape in the event of an overload and there is an opening range between the comminution roller and the comb, so that damage to the machine is at least substantially avoided.

For example, an overload can be caused by the fact that the diameter of a feed material piece corresponds to or is larger than the clearance between the comminution roller and the comb, so that the feed material piece in question cannot be comminuted without further ado. In order to solve this problem, the comb is designed as a swing arm that can be pivoted about an axis. Therefore, the comb is also called "comb beam swing arm".

For inspection purposes or to replace the comb, the large comb flap can be opened so that easy, almost ground-level access to the inner machine range can be guaranteed, wherein by means of this access the cleaning or maintenance and repair works can be carried out. The comb flap can be pivoted either in the upper range or in the lower range of the machine frame. When the comb flap is pivoted open, the comb is also moved at the same time, so that the entire unit can be opened when the comb flap is pivoted open.

In the state of the art, it is planned that the comb is pivotably mounted on the comb flap. A spring means acts on the comb, the first end of which engages the comb and the second end of which is mounted on the comb flap. By arranging the second end of the spring means on the comb flap, the entire reaction forces from the comminution process are absorbed by the comb flap and transferred via this to the machine frame. This design requires the comb flap to be reinforced to achieve high stiffness.

The disadvantage here is that the very stiff design of the comb flap and/or the comb results in high costs of the machine and an increased weight of the entire comminution apparatus makes it considerably more difficult to transport the comminution apparatus, for example when changing the location. Especially for mobile machines, it is desirable to keep the weight of the comminution apparatus as low as possible, as mobile machines are limited in their total weight due to approval regulations.

The DE 299 10 772 U1 shows a comminution machine with fixed teeth arranged in a comb-like manner and a rotor with rotor teeth attached to the circumference and offset laterally with respect to the fixed teeth, which can be moved between the fixed teeth arranged in a comb-like manner as the rotor rotates.

The task of the invention is now to provide a comminution apparatus which avoids or at least substantially reduces the aforementioned disadvantages in the state of the art. In particular, the task of the present invention is to provide a comminution apparatus which is lighter than the comminution apparatuses known in the state of the art.

In the case of a comminution apparatus of the type mentioned at the beginning, the aforementioned task is at least substantially solved by the fact that the second end of the spring means is supported directly on the machine frame.

By supporting the spring means with the second end directly on the machine frame, a significant reduction of the bending moment occurring at the comb flap is achieved compared to the state of the art, since the reaction forces absorbed by the comb are directly transferred into the machine frame without being guided over the comb flap. As a result, the comb flap must at least substantially absorb almost no or only minor loads, which are then transferred directly into the machine frame. It is advantageous that at least substantially no force flow is present in the comb flap, so that the comb flap prefers to be designed only for its necessary inherent stability and can therefore be designed in a simple and weight-reduced manner.

As a result of the fundamental change in the force and/or torque curve and/or the force flow in the comminution apparatus, the comb flap now only takes up the weight of the comb, in particular the comb beam swing arm, and preferably does not absorb any more forces from the working process as such. In any case, the comb flap is relieved of most of the reaction forces and can therefore be designed to save weight.

This results in a significant reduction of the total weight of the comminution apparatus, in particular by up to 60% compared to the comminution apparatuses known from the state of the art, as well as a drastic reduction of the plant costs, since a significant material saving can be achieved in the design of the comb flap.

At first glance, the solution according to the invention appears to be disadvantageous, since the longitudinal axis of the spring means is arranged at an angle to the comb which differs from the 90° angle. It is important in this context that the 90° angle between the longitudinal axis of the spring means and the comb ensures the best possible transfer of force from the comb to the spring means. During the development of the invention, it could be established that the advantages of an arrangement of the spring means according to the invention clearly outweigh the disadvantages with regard to the deviation of the 90° angle. Although the force transfer of the reaction forces acting on the comb does not take place at the optimum 90° angle, an arrangement of the spring means with its second end on the machine frame allows a significant reduction, namely by up to 90%, of the bending moment acting on the comb flap. Due to the reduced bending moment, the comb flap can be made much less stiff, wherein at the same time ensuring plant and/or work safety.

The spring means also acts as a damping means, so that the comb can escape in the event of overload and so that there is a wider distance between the comminution roller and the comb. This means that damage to the machine, which would otherwise be caused in particular by an overload, can be avoided.

In a particularly preferred embodiment, the hinge center points of the comb flap and the hinge point of the spring means at its second end are arranged and/or lie at least substantially on the same kinematic axis. The comb flap rotates around the kinematic axis when pivoted. In regular operation, the comb flap is fastened to the machine frame. It is therefore advantageous that when the comb flap is opened and/or pivoted open, especially together with the comb, no change in position of the comb relative to the comb flap is caused. By avoiding a relative movement of the comb to the comb flap, the control complexity of a hydraulic movement during the pivoting process of the comb flap is reduced.

Since any deviation from the 90° position of the spring means causes a deterioration in the behavior of the machine, it is advantageous to arrange the spring means as close as possible to the 90° position. The 90° position is related to the tangential effect, which refers to the circular displacement of the comb when it moves in the event of an overload. The arrangement of the second end on the kinematic axis and/or onto the kinematic axis preferably results in the smallest deviation from the 90° position with simultaneous support and/or mounting of the spring means on the machine frame. If an increased distance from the linkage point of the spring means to the kinematic axis were to be implemented, this could lead to an extreme stretching position of the spring means in the event of a maximum deflection and/or deflection as a result of an overload, in particular wherein it would be very difficult to pivot back and/or deflect the comb into the working position. This movement would require forces above average and would also result in increased consumption of the required amount of oil. This would then cause an extreme deterioration in the time behavior and weight balance of the comminution apparatus. If the articulation point of the spring means were not located in and/or near the kinematic axis, i.e. in the alignment of the comb flap hinges, a relative movement of the comb drive to the comb flap would occur during a pivoting process of the comb flap. As a result, possible pinching points would be created which could impair work safety as the operating personnel would have access to these areas. The arrangement of the second end of the spring means on the kinematic axis in accordance with the invention avoids the aforementioned disadvantages.

Preferably, bearing brackets with bearing openings are provided and/or fastened to the machine frame, which serve for connection and/or coupling with the comb flap and the spring means. It is particularly preferred if the centers of the bearing openings lie on the kinematic axis. The arrangement of the centers of the bearing openings on the kinematic axis has the advantage that the comb flap can be opened without changing the position of the comb relative to the comb flap. In particular, the bearing brackets allow the comb flap and/or the spring means to be easily arranged on the machine frame. The comb flap is arranged above the bearing brackets with its pivot bearing at the bottom of the machine frame. The upper part of the comb flap indicates that it faces the material to be comminuted, which is fed to the comminution apparatus, and the lower part in particular faces a ground on which the comminution apparatus is positioned.

In a further advantageous configuration of the inventive idea, it is provided that the comminution apparatus has at least one locking device for locking the comb flap in the closed state of the comb flap, wherein the locking device is effective between the comb flap and the machine frame. The locking device locks the comb flap to the machine frame. At the locking points, the comb flap supports the comb beam and/or comb to the machine frame for short path lengths. Preferably the comb flap is stiffened in this range, but this stiffening in particular is negligible in comparison to the total weight and/or in comparison to the proportion of the total weight, wherein the costs resulting from the stiffening of the comb flap in the range of the locking device are almost negligible and/or do not carry weight. In these ranges a certain force transfer of the reaction forces of the comb to the comb flap takes place, which are transferred to the machine frame via the locking device. However, the interlocking device preferably does not absorb high forces from the working process, since the majority of the forces and moments occurring are transferred directly to the machine frame by means of the spring means. After unlocking the locking device, the comb flap can be pivoted open together with the comb so that there is an opening range and/or access possibility to the inner range of the comminution apparatus.

In accordance with an advantageous embodiment, the locking device has locking bolts, in particular wedge-shaped locking bolts, wherein the locking bolts are arranged on the comb flap and wherein the machine frame has locking openings for engagement of the locking bolts. For locking the comb flap and/or for firmly connecting the comb flap to the machine frame, the locking bolts are brought into engagement with the locking openings of the machine frame by being introduced into the locking openings. In another preferred embodiment, the locking bolts are fixed in their end position, in particular in the locked state of the comb flap, so that the locking device can only be opened and/or the comb flap pivoted open after the locking bolts have been released.

In addition, the locking bolts are provided on the side of the comb flap opposite the pivot bearing of the comb flap.

In another particularly preferred design, the comb is designed as a comb beam swing arm mounted at least in the range of its two ends. The design of the comb as a comb beam swing arm allows the comb to escape in the event of overload and enables a gap to be left between the comminution roller and the comb, which preferably ensures the removal of comminuted material, which in particular has a critical diameter. Due to the design of the comb as a comb beam swing arm, the comb is pivotably mounted on the comb flap. Ultimately, it shall be understood that the comb can also be designed in several parts, wherein the counter tools of the comb are designed to interact with the comminution tools of the comminution roller.

Preferably, the comb extends at least substantially over the entire width of the comb flap and can pivot in the side edge range of the comb flap. In particular, the comb also extends at least substantially over the width of the comminution roller, wherein the counter tools of the comb cooperate with the comminution tools of the comminution roller in such a way that comminution of the material to be comminuted results. The comb is mounted on the one hand by the spring means on the machine frame and on the other hand pivotably on the comb flap. Since it is advantageous for the comb to extend across the width of the comb flap, the pivot bearing is provided at the end face of the comb flap, i.e. in the side edge range of the comb flap. The pivot bearing of the comb in other embodiments does not have to be provided directly at the end face of the comb flap, but only in a range near the end face of the comb flap. In the case of a multi-part comb, the comb is preferably mounted so that it can pivot not only in the side edge ranges of the comb flap, but also, for example, in the central range of the comb flap. The pivot bearing of the comb only has to absorb small reaction forces and transfer them to the comb flap, since a large part of the forces and moments occurring during the working process are transferred to the machine frame via the spring means.

In addition, the comb is preferably mounted in the upper range of the comb flap, wherein the pivot bearing points of the comb are arranged adjacent to the locking bolts of the locking device. Preferably the distance between the pivot bearing points of the comb and/or the pivot bearing of the comb and the locking bolts is 1 cm to 100 cm, preferably from 5 cm to 50 cm, further preferably from 5 cm to 30 cm. Within this range, the reaction forces, which account for a small proportion of the total reaction forces, are taken over by the comb flap and transferred to the machine frame via the locking device and/or via the locking bolts.

The comb flap is preferably more stiff in the range between the pivot bearing of the comb and the locking bolts than in the remaining range of the comb flap, so that safe operation of the comminution apparatus is guaranteed.

In a particularly preferred design, the comb is located in the upper range of the comb flap and in the side edge ranges, i.e. in the upper side edge ranges of the comb flap. With this embodiments, it is particularly advantageous if the comb is made in one piece and supported on the comb flap by two pivot bearing points.

As mentioned above, the comb is advantageously designed so that it can perform a pivoting movement. In this case, the spring means is designed in such a way that it allows the comb to pivot, in particular to increase the distance, preferably the clear distance, between the comminution roller and the comb, in particular in the event of overload. The distance between the comminution roller and the comb is more than 2 cm and can be increased up to 20 cm, especially in the event of an overload and during a deflective movement, especially up to 40 cm. After an deflective process and/or after a pivoting movement of the comb, the comb returns to its initial position due to the spring force of the spring means. A deflective movement of up to 40 cm makes it possible to eject non-comminutable material.

Another advantageous design variant provides that the spring means is designed as a hydraulic cylinder and/or pressure holding cylinder. The movement of the spring means is preferably force-controlled, wherein the comb, in particular the comb beam swing arm, can pivot in the event of an overload. For example, a hydraulic guard control for the force-controlled pivoting movement of the comb can be carried out by means of hydraulic cylinders with a defined pre-pressure accumulator. The spring means are preferably designed in such a way that they can adjust the inclination of the comb around its longitudinal axis and increase and/or decrease the distance to the comminution roller. The spring means take over a large part of the forces resulting from the support of the comb. The cylinders absorb the forces and transmit them to the machine frame. In addition, the aforementioned cylinders also serve in particular to set the comb against the comminution roller, depending on the desired comminution result.

In another particularly preferred embodiments, the spring means is designed as a hydraulic cylinder and coupled with a hydraulic control device. The hydraulic control device is designed in such a way that it can control and/or regulate, in particular change and/or adjust, the spring force of the hydraulic cylinder, in particular in connection with the pressure accumulators of the hydraulic cylinders.

In order to move and/or pivot the comb, the spring means performs a work, which is why the aforementioned cylinders can also be assigned to the working cylinders. The cylinders can at least substantially have the shape of a circular cylinder and/or be designed as hollow cylinders.

It is particularly preferred when in each case one spring means engages at the rear side in the lateral range comb with its first end. The first end of the spring means characterises that the spring means engages the comb with its one end range. The second end, on the other hand, engages in a bearing bracket of the machine frame. It is advantageous that at least two spring means engage with the comb, wherein at least one spring means engages with side edge range of the comb. Preferably, the comb of this embodiment is formed in one piece and extends, at least substantially, over the width of the comb flap. In particular, the lateral spring means take over the largest part of the reaction forces from the working process and divert the reaction forces into the machine frame. The reaction forces are absorbed axially by the longitudinal axis of the spring means supporting the comb beam.

Furthermore, it is particularly preferred that a further spring means engages the central range of the comb with its first end at the rear. It is preferable that at least two spring means engage on the rear side of the lateral range and at least one further spring means engages on the rear side of the central range of the comb each with their first ends. The use of the additional cylinder also ensures support for the central range of the comb, wherein the bending load on the comb can so be greatly reduced, as the additional spring means also transfers the reaction forces from the central range of the comb directly into the machine frame.

It is advantageous for another version of the invention that the comminution apparatus has a device for measuring and/or controlling and/or regulating the pivot angle of the comb. A displacement measuring means is advantageously provided for measuring the pivot angle of the comb and/or the distance of the comb from the machine frame, preferably for determining the distance of the comb from the comminution roller, wherein the device has this displacement measuring means and/or wherein the device is coupled to the displacement measuring means. Furthermore, the spring means is also coupled to the device, wherein the spring means is able to adjust the pivot angle of the comb. The displacement measuring means is coupled in particular via the device to the spring means and/or the spring means, wherein the measured distance of the comb from the machine frame is usable for controlling and/or regulating the pivot angle of the comb. It is advantageous to use the spring means to adjust the pivot angle of the comb, so that the displacement measuring means can have an indirect influence on the spring means and in particular on the pivot angle of the comb. In addition, the displacement measuring means can also record special operating conditions, in particular wherein if the pivot angle of the comb deviates too much from the nominal value, an immediate switch-off of the comminution apparatus can be triggered. If, for example, the material to be comminuted is not comminutable and has a diameter which exceeds the maximum pivot movement of the comb, this can be recorded in particular by the displacement measuring means. Since this excessively large, non-comminutable feed material would cause a pivot movement of the comb which would extend beyond the range of the permitted pivot movement of the comb or would border on the maximum limit value of the pivot angle of the comb, it makes sense to switch off the comminution apparatus, particularly with regard to safety aspects. After an immediate switch-off, this critical feed material can be manually removed from the comminution apparatus by the operating personnel.

The displacement measuring means, which is designed in particular as a cylinder, is preferably arranged with one end at the rear of the comb and with its other end on the machine frame, preferably on the kinematic axis. One end of the comb engages the rear of the comb and the other end engages the machine frame. Bearing brackets with one bearing opening each on the machine frame are also provided for the displacement measuring means. It is of particular advantage if the bearing brackets for the displacement measuring means are arranged on the kinematic axis, in particular wherein the center of the bearing opening for the displacement measuring means is also located on the kinematic axis, so that preferably all centers of the bearing brackets for the spring means and for the displacement measuring means lie on the same axis, so that there is no change in position of the other end of the displacement measuring means to the comb flap when the comb flap is pivoted open and/or when the comb flap is pivoted, in particular in a circular manner.

In another preferred embodiment, the displacement measuring means is designed as a sensor, in particular wherein the device is coupled to a storage device which records and stores the movement of the comb and/or the pivot angle of the comb. This means that operating sequences can be traced, especially for later evaluation. The distance measuring means can be used to set the end position of the comb at least substantially freely, preferably by controlling and/or regulating it. For the control and/or regulation loop, the distance measuring means indicates the position of the comb, in particular the comb beam swing arm.

Another preferred embodiment also provides for an opening device to be effective between the machine frame and the comb flap, wherein the opening device is designed for automatic pivoting of the flap. After the comb flap is opened, the opening device allows access to the inner range of the comminution apparatus in order to maintain or replace the tools of the comminution roller as required. In addition, the opened opening flap also allows access to the comb in order to service and/or replace the counter tools of the comb.

It is advantageous that the opening device pivots the comb flap around the kinematic axis, wherein the hinge center points and/or the pivot bearing of the comb flap are located on the kinematic axis. The opening device is preferably designed in such a way that a force-controlled lowering of the comb flap is ensured. Preferably, the opening device can only initiate a pivoting of the comb flap when the locking device is unlocked and permits a pivoting of the comb flap.

The opening device preferably has at least one hydraulic cylinder, one end of which is attached to the machine frame, in particular to a lateral bearing wall, and the other end of which is attached to a longitudinal edge side of the comb flap. The hydraulic cylinder enables the comb flap to be pivoted and/or pivoted open in a force-controlled manner. In particular, one hydraulic cylinder is provided on each of the longitudinal edge sides of the comb flap. The hydraulic cylinders are supported by the machine frame when the comb flap is pivoted.

A material feed hopper, especially directly on the machine frame, is preferred for feeding the material to be comminuted above the comminution roller and the counter comb. The material feed hopper can also be arranged above the comminution apparatus, in particular not connected to the machine frame.

In a further, very special embodiment, the machine frame has a first bearing wall and a second bearing wall opposite the first bearing wall, wherein at least one comminution roller is provided between the first bearing wall and the second bearing wall, wherein in the range of a first opening in the first bearing wall a connection of a gearbox protrudes, to which the comminution roller is connected by means of gears at its first end face facing the gearbox connection, and wherein an opening for the comminution roller is provided in the second bearing wall.

In the aforementioned preferred configuration, an outwardly open opening range is provided starting from at least one edge of the second bearing wall and merging into the second opening.

It is advantageous that, in addition to the outwardly open opening range of the second opening, the comminution apparatus is characterized in that it has at least one of the following features:

a) in that the opening width of the second opening and of the opening range are in each case greater than the outer diameter of the roller body of the comminution roller, and/or
b) in that the comminution roller is connected to the second bearing wall in the range of its second end face, in particular wherein a flange connection of the comminution roller, via a fastening plate, in particular the fastening plate covering the opening range, and/or
c) in that at least one fastening means is provided which bridges the opening range, in particular in the range of the edge, and is designed for connecting the ranges of the second bearing wall which adjoin the opening range, and/or
d) in that effective centering means are provided between the fastening plate and the second bearing wall for centering the comminution roller, and/or
e) in that the centering means have at least two centering journals engaging in centering openings and in that, preferably, the length of the centering journals is greater than the length of the connection by means of gears between the comminution roller and the gearbox, and/or
f) in that the fastening plate, in particular on the underside and facing the ground, has a flattened range, and/or
g) the comminution roller is moved out of and/or into the comminution apparatus over the opening range, and/or
h) that the comminution roller is first moved in the axial direction and then in the radial direction upwards and/or laterally and/or downwards after loosening the connection of the gearbox and/or before coupling with the connection of the gearbox, and/or i) that the comminution roller is arranged on a flat ground after being moved out of the apparatus over the flattened range of the fastening plate, and/or j) that the drive end of the comminution roller is placed on a bearing block, and/or k) in that the comminution roller is rotated in the dismantled state from the apparatus, supported on the fastening plate and the bearing block, in particular for changing damaged comminution tools.

As a result, the invention concerns a comminution apparatus and/or an apparatus for comminution with a comb arranged on the comb flap, wherein the comb is supported directly on the machine frame by means of at least one spring means. In accordance with the invention, the load on the comb flap is significantly reduced so that the entire comminution apparatus can be designed to save weight.

Further features, advantages and possible applications of the present invention can be seen in the following description of examples of execution on the basis of the drawing and the drawing itself. All features described and/or depicted, either in themselves or in any combination, form the subject matter of the present invention, irrespective of their combination in the claims or their relationship.

It shows

FIG. 1 a schematic perspective of a comminution apparatus according to the invention, FIG. 2 a schematic cross-sectional view of a comminution apparatus according to the invention according to FIG. 1, FIG. 3 a schematic perspective representation of components of a comminution apparatus according to the invention, FIG. 4 a schematic perspective view of the detail view A according to FIG. 3, FIG. 5 a schematic perspective explosion view of components of a comminution apparatus according to the invention, FIG. 6 a schematic perspective explosion view of the detailed view B according to FIG. 5, FIG. 7 a schematic side view of the components of a comminution apparatus according to the invention, FIG. 8 a schematic perspective view of components of another embodiment of the invention comminution apparatus, FIG. 9 a schematic perspective view of components of another embodiment of the invention comminution apparatus, FIG. 10 a schematic perspective view of the comminution roller in disassembled condition, FIG. 11 a schematic representation of the process sequence according to the invention for dismantling a comminution roller and FIG. 12 an schematic representation of the process sequence for mounting a comminution roller according to the invention, FIG. 13 a schematic perspective representation of components of a comminution apparatus according to the invention, FIG. 14 a schematic side view of components of an apparatus according to the invention from FIG. 13, FIG. 15 a schematic perspective representation of components of a comminution apparatus according to the invention, FIG. 16 a schematic side view of the components of a comminution apparatus according to the invention from FIG. 15, FIG. 17 a schematic perspective representation of components of a comminution apparatus according to the invention, FIG. 18 a schematic side view of the components of a comminution apparatus according to the invention from FIG. 17 and FIG. 19 a schematic perspective representation of components of a comminution apparatus according to the invention.

FIG. 1 shows a comminution apparatus 1 for use in comminution of material to be comminuted, having a first bearing wall 2 and a second bearing wall 3, wherein a comminution roller 5 and/or its roller body 14, which has comminution tools 22, is provided between the first bearing wall 2 and the second bearing wall 3. The first bearing wall 2 has a first opening 6 for the arrangement of the comminution roller 5. The second bearing wall 3, on the other hand, has a second opening 10 for the arrangement of the comminution roller 5. The first bearing wall 2 and the second bearing wall 3 as well as the roller body 14 are enclosed in a machine frame 4, as shown in particular in FIG. 2. FIG. 1 does not show all the components required for the function of the comminution apparatus 1. FIG. 1 shows neither the flange connection 16 nor the fastening plate 17.

Comminution apparatuses 1 of the type in question can basically be used in all ranges in which a feed material is to be comminuted. In particular, apparatuses 1 of the type in question are used for comminution waste and recycling material.

FIG. 3 shows components of an apparatus 1, intended for use for comminution, with a machine frame 4 having a first bearing wall 2 and a second bearing wall 3 opposite the first bearing wall 2, with at least one comminution roller 5 provided between the first bearing wall 2 and the second bearing wall 3, wherein a gearbox connection 7 of a gearbox 8 projects through a first opening 6 in the first bearing wall 2, to which gearbox connection the comminution roller 5 is connected by means of gears at its first end face 9 facing the gearbox connection 7, and wherein a second opening 10 for the comminution roller 5 is provided in the second bearing wall 3.

It should be expressly pointed out that it is in principle also possible for a comminution apparatus 1 of the type in question to have not only one comminution roller 5 but a plurality, in particular two, of comminution rollers 5.

It is now essential that, starting from at least one edge 11 of the second bearing wall 3, an outwardly open opening range 12 is provided, which merges into the second opening 10. This results in particular from FIG. 5. The second opening 10 of the second bearing wall 3 is thus accessible from the outside to at least one edge side 11 of the second bearing wall 3 via an opening range 12. The comminution roller 5 can be removed from the comminution apparatus 1 via the opening range 12 and/or inserted into the comminution apparatus 1 via the opening range 12 and coupled to the gearbox connection 7.

Furthermore, FIG. 5 shows that the opening width 13 of the second opening 10 and the opening range 12 is larger than the outer diameter of the comminution roller 5. The comminution roller 5 comprises the roller body 14 and the comminution tools 22.

In accordance with the design examples shown in FIG. 5 to FIG. 10, the comminution roller 5 is connected to the second bearing wall 3 via a fastening plate 17. The fastening plate 17 is arranged in the range of the second end face 15 on the comminution roller 5. As shown in FIGS. 3 and 4, the fastening plate 17 covers the opening range 12 and the second opening 10.

Furthermore, FIGS. 3 and 4 make it clear that the comminution roller 5 is arranged on the fastening plate 17 via a flange connection 16 and/or mounted and/or fastened on the fastening plate 17 via screw connections. The flange connection 16, which has an substantially ring-shaped shape, is fastened to the end face of the roller body 14 and serves to connect the comminution roller 5 to the fastening plate 17. In further, not illustrated design examples, the flange connection 16 can serve for the direct connection of the comminution roller 5 with the second bearing wall 3, wherein in this case a fastening plate 17 can be completely omitted.

In addition, FIGS. 8 and 9 show that, in addition to the fastening plate 17, a fastening means 18 covering and/or bridging the opening range 12 is provided which is designed to connect the ranges of the second bearing wall 3 adjacent to the opening range 12. The fastener 18 is firmly connected to the second bearing wall 3 according to FIG. 8, in particular via screw connections.

It is not shown that fastener 18 can also be used without a fastening plate 17.

The fastener 18 is arranged in the range of the edge 11 of the second bearing wall 3, so that the opened opening range 12 only results after loosening the fastener 18.

Figure 6:
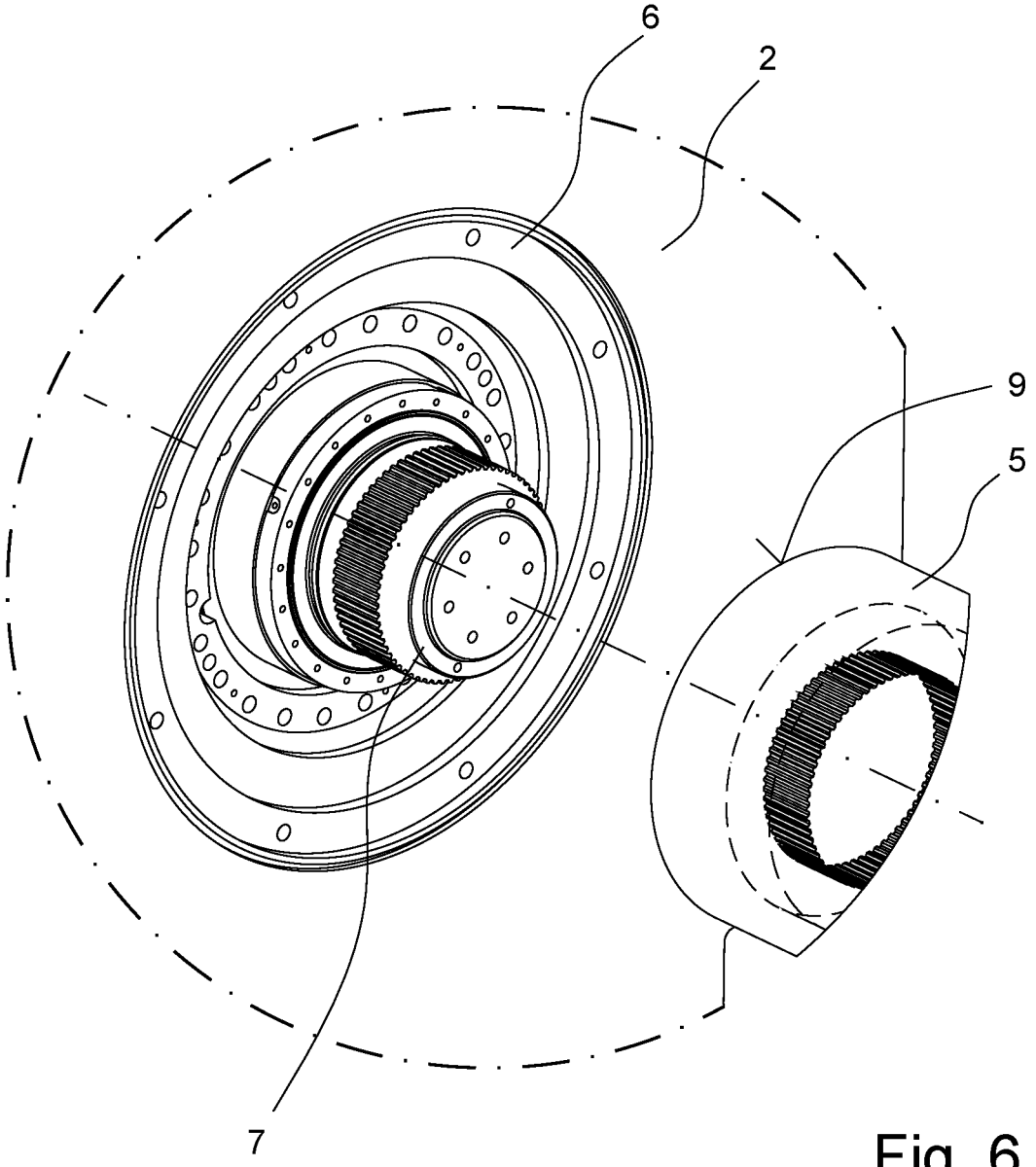

Furthermore, FIG. 6 shows that the gearbox connection 7 has the shape of an externally toothed multiplicity shaft journal. Corresponding to the externally toothed shaft journal, the comminution roller 5 has an internally toothed element and/or an internal toothing, so that the connection by means of gears between the gearbox connection 7 and the comminution roller 5 can be produced.

Moreover, it shall be understood that it is easily possible to produce other geometric shapes instead of toothing to produce a positive connection between the gearbox connection 7 and the comminution roller 5. It is also understood that a coupling journal can also be provided on the comminution roller 5, while a corresponding opening corresponding to the journal can then be provided on the gearbox 8 to produce a positive connection.

In the version shown, the first end face 9 of the comminution roller 5 serves for coupling with the gearbox connection 7, which in turn is arranged within the first opening 6 on the first bearing wall 2. The internal teeth of the comminution roller 5 in the range of the first end face 9 have recesses and/or projections corresponding to the projections and/or recesses of the shaft journal. FIG. 6 shows that the shaft journal of the gearbox connection 7 protrudes from the first bearing wall 2 and is arranged in the inner range of the comminution roller 5.

It is not shown that in further embodiments a journal can also project from the comminution roller 5 in the range of the first end face 9, which is connected to the gearbox connection 7, wherein the gearbox connection 7 of the gearbox 8 then has an opening and no longer necessarily projects from the first bearing wall 2.

Figure 5:
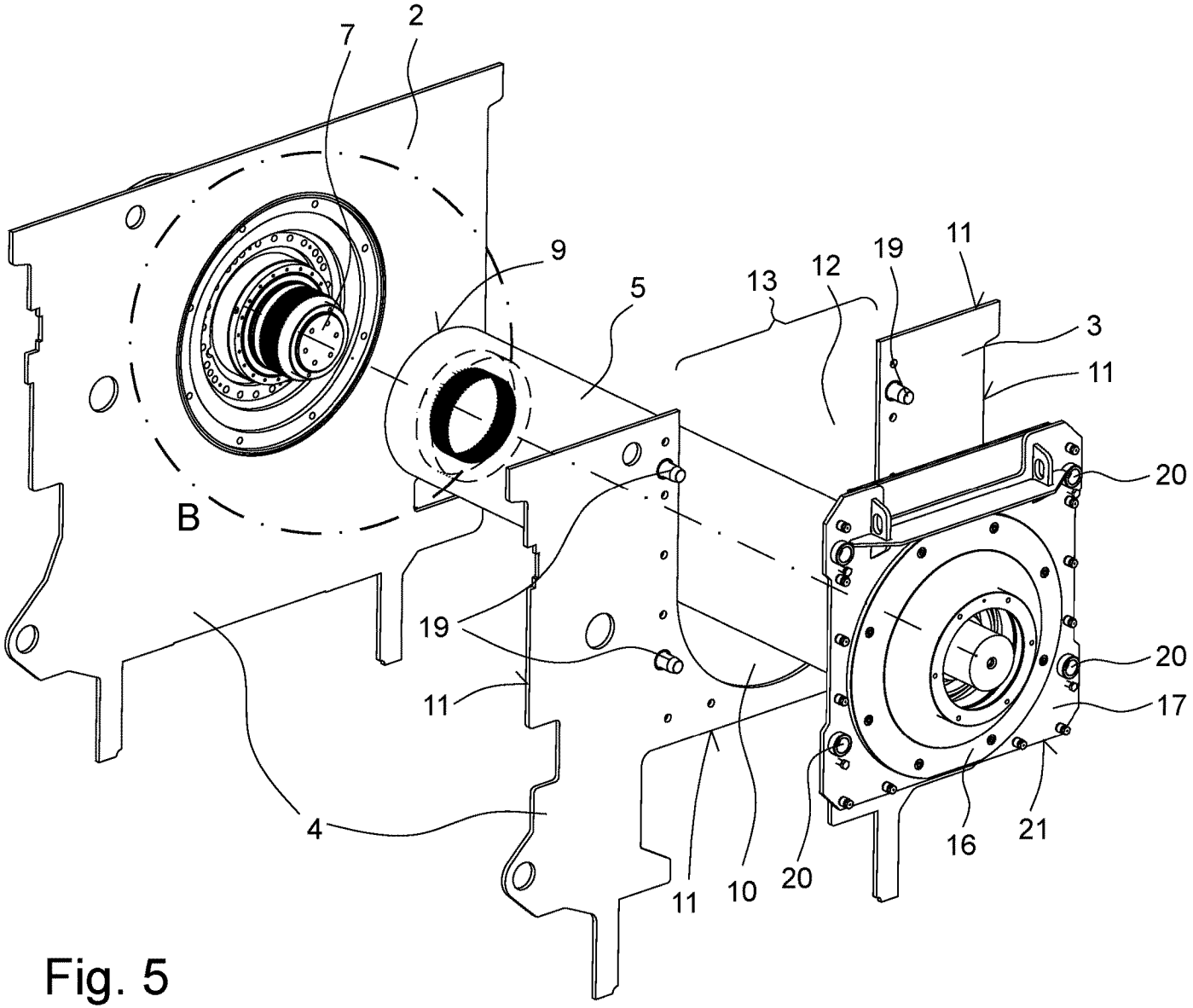

The opening range 12 in combination with the second opening 10 forms and at least substantially U-shaped overall opening on the second bearing wall 3, which is open to the outside. FIG. 5 shows that this U-shaped overall opening is open at the top and/or to the upper edge side and/or edge 11 of the second bearing wall 3. The comminution roller 5 is therefore removed from apparatus 1 via the upper edge 11 of the second bearing wall 3.

In other examples not shown, the comminution roller can also be removed laterally and/or downwards from the comminution apparatus 1, wherein the opening range 12 then extends from the second opening 10 to the edges 11 of the sides and/or the lower edge 11 of the second bearing wall 3 as required.

Figure 7:
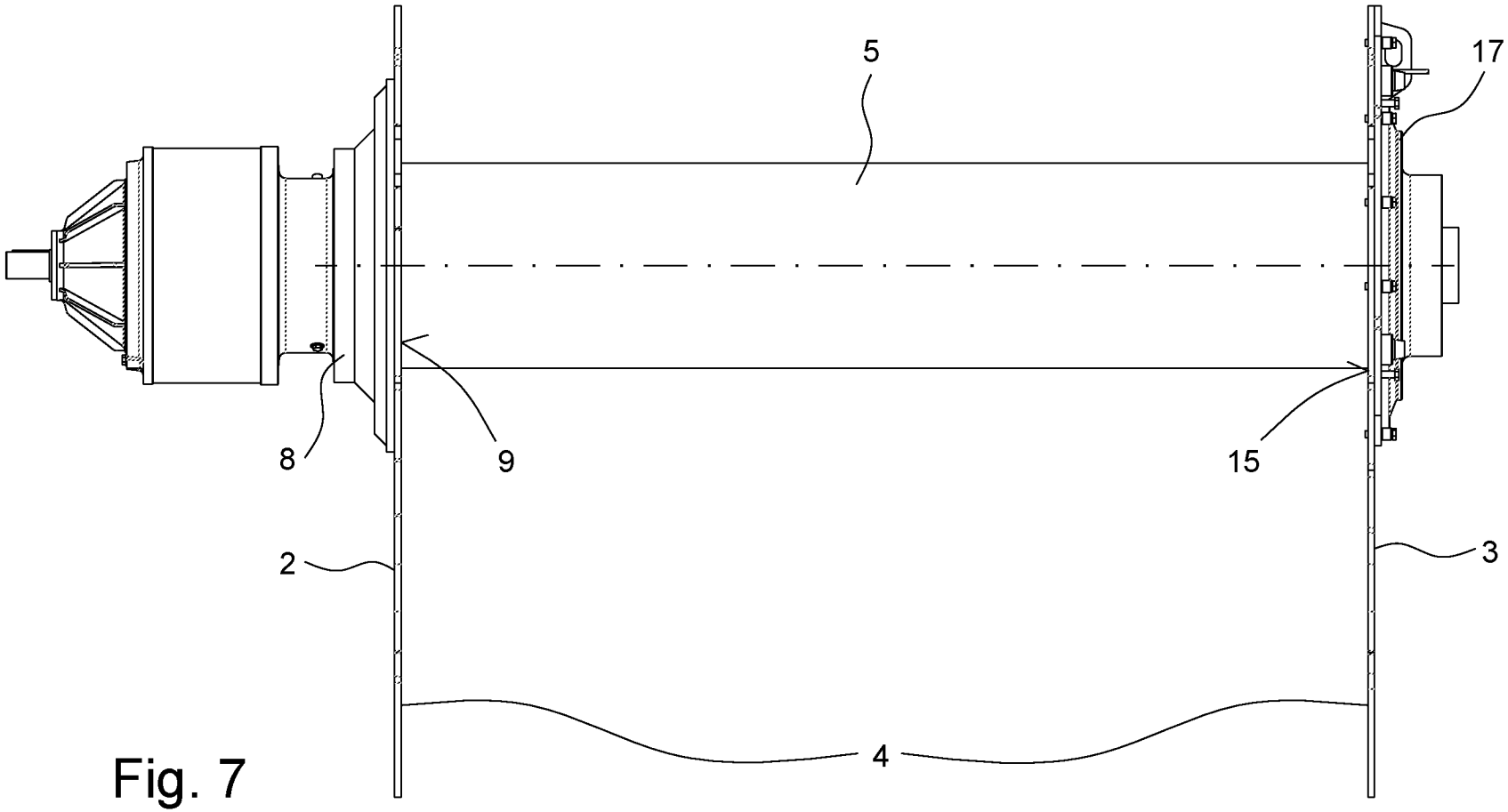
Figure 8:
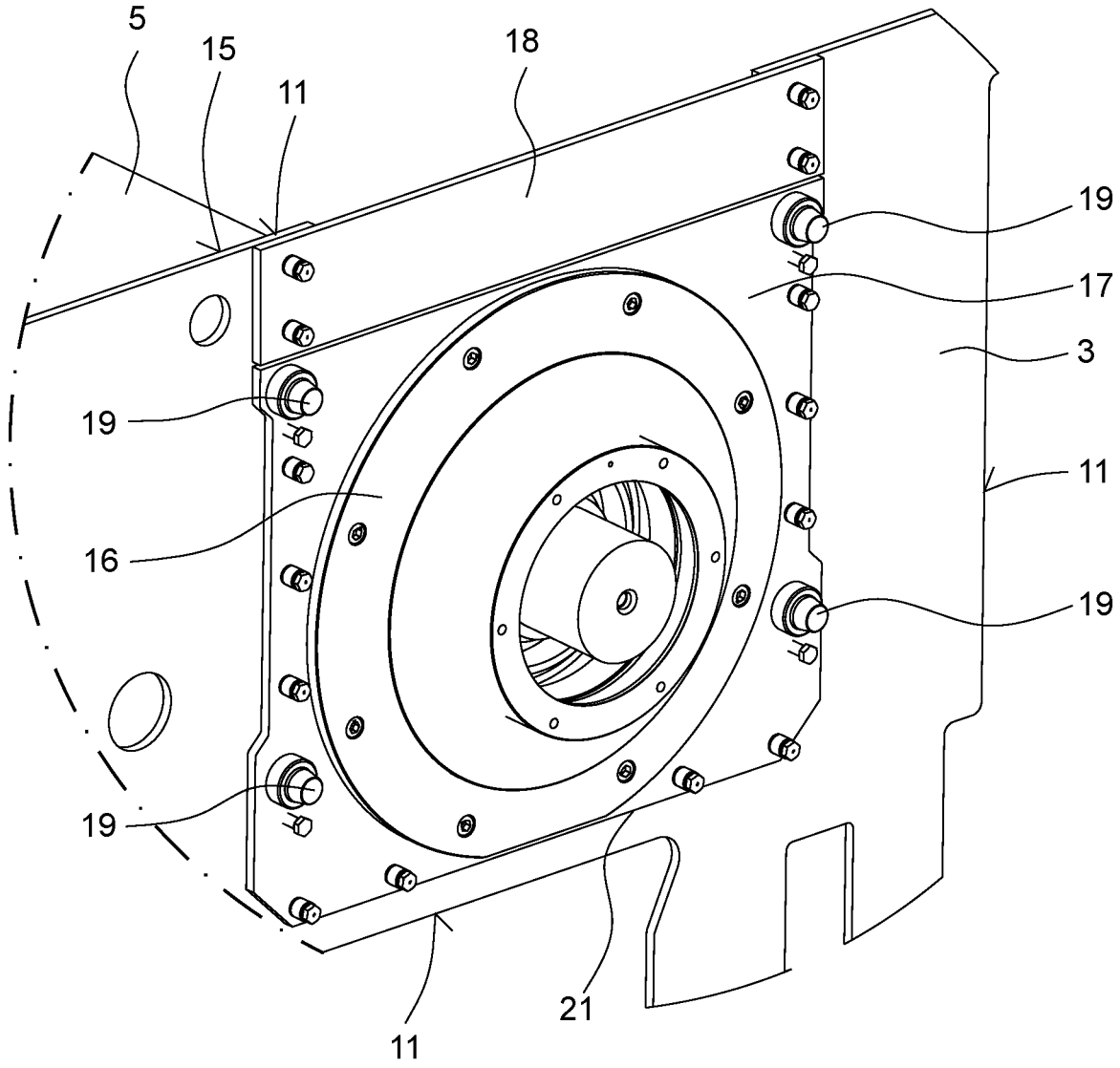
FIG. 8 shows that the fastening means 18 is provided in the form of a plate, in particular a rectangular plate, which is connected at its two end faces to the second bearing wall 3, in particular non-positively.
Figure 9:
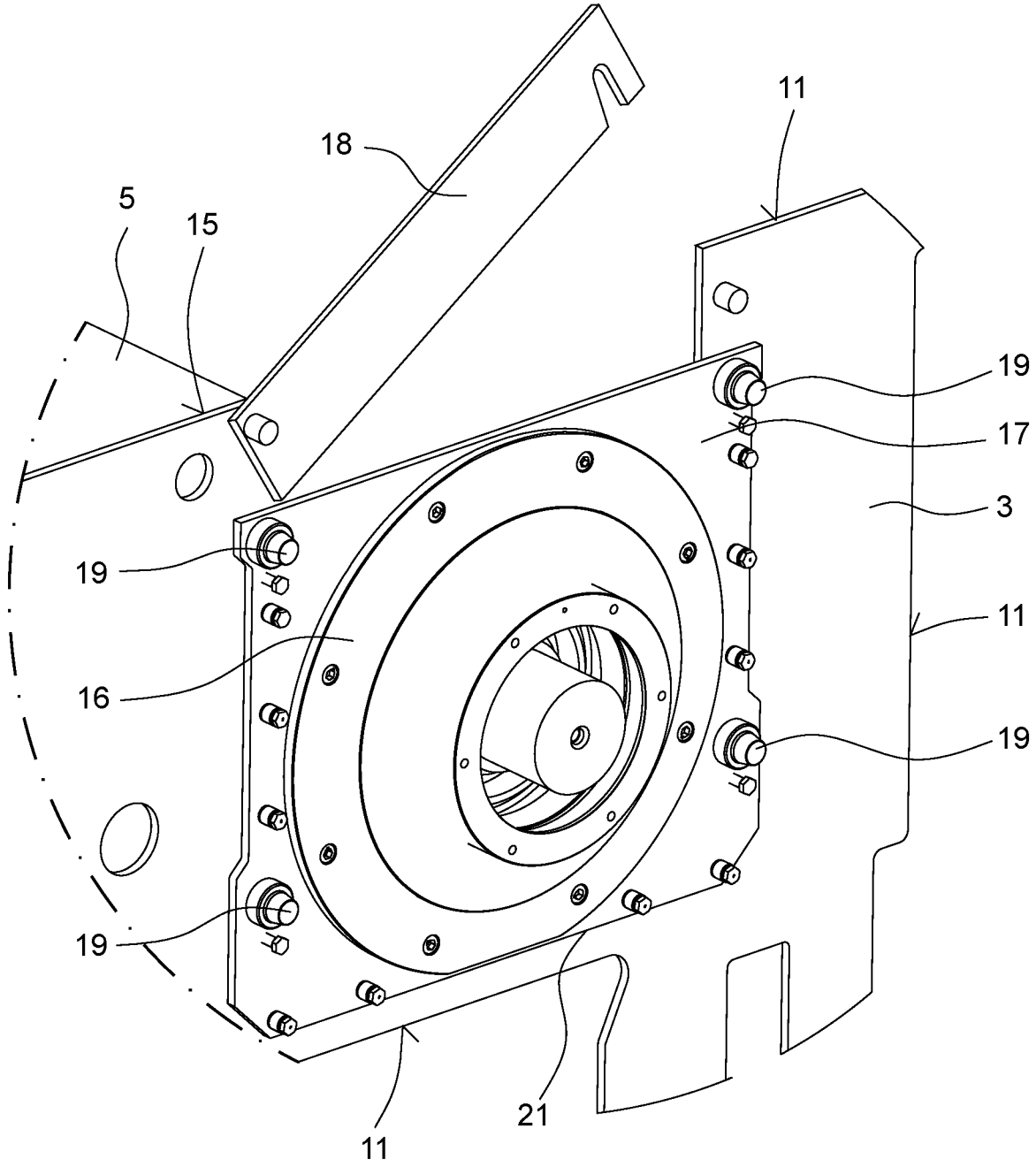
FIG. 9 shows that a bracket that can be pivoted open and/or pivoted is provided as fastener 18. The bracket can be designed so that it can be pivoted open by using a hinge and/or a ribbon.

As shown in FIG. 7, the comminution roller 5 is driven via the gearbox 8 by a motor which is not shown.

Figure 4:
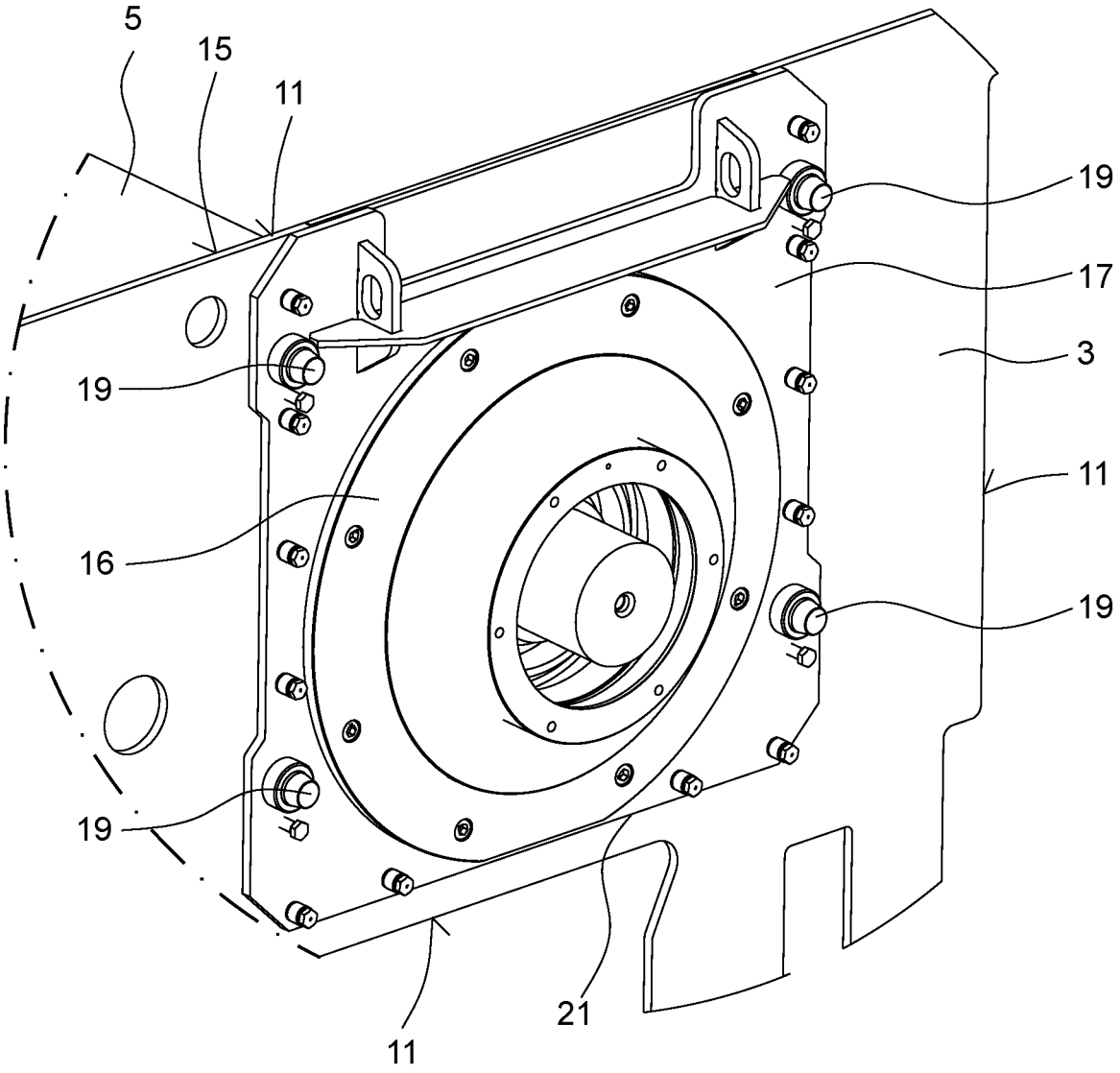

Furthermore, FIGS. 4 and 5 show that effective centering means 19 are provided between the fastening plate 17 and the second bearing wall 3 for centering the comminution roller 5. These centering means 19 are, according to the embodiments shown, at least substantially cylindrical in the form of a journal. Centering openings 20, which are designed to receive the centering journals, correspond to the centering means 19, in particular the centering journals. In accordance with FIG. 5, the centering journal is provided on the second bearing wall 3, in particular on the ranges of the second bearing wall 3 adjacent to the opening range 12 and to the second opening 10. In further, not illustrated design examples, the centering journal can also be provided on the fastening plate 17 and/or on the flange connection 16 of the comminution roller 5.

It is not shown that the centering journals have a length which is greater than the length of the connection by means of gears between the comminution roller 5 and the gearbox 8, so that during assembly centering is first effected via the centering journals and only then is the connection by means of gears between the comminution roller 5 and the gearbox 8 established.

FIG. 4 shows clearly that the fastening plate 17 has screw connections 23 for arrangement on the second bearing wall 3. According to FIG. 4, twelve screw connections 23 are provided. After loosening the screw connections 23, the fastening plate 17 can be separated from the second bearing wall 3 so that the fastening plate 17 is detachably connected to the second bearing wall 3 and thus to the machine frame 4. In addition, the flange connection 16 of the comminution roller 5 has at least two screw connections 24. According to FIG. 2, the flange connection 16 has eight screw connections 24 for arrangement on the fastening plate 17. In other embodiments not shown, the screw connections 24 of the flange connection 16 can be provided for direct arrangement on the second bearing wall 3.

It is also not shown that the flange connection 16 has eight threaded holes which are then designed to accommodate jacking screws. Not only the flange connection 16 can have the aforementioned threaded holes, but also the fastening plate 17. It is understood that the jacking screws can also be used through threaded holes on the second bearing wall 3.

The jacking screws are designed in such a way that they allow a spatial separation between the fastening plate 17 and/or the flange connection 16 of the comminution roller 5 and the second bearing wall 3 when screwing in. When the comminution apparatus 1 is mounted, either the jacking screws are not arranged in the threaded holes or they are secured, especially with lock nuts.

Instead of jacking screws, a further design example which is not shown here provides that actuators, in particular adapted hydraulic actuators, are used so that a horizontal and/or axial movement of the comminution roller 5 for separating the gearbox connection 7 from the inner range of the comminution roller 5 is ensured.

According to FIGS. 4 and 5, the fastening plate 17 has a flattened range 21 at its lower edge 11. This flattened range 21 is designed in such a way that it can be arranged on a flat ground, wherein it prevents the fastening plate 17 and the comminution roller 5 attached to it from tipping over.

Figure 1:
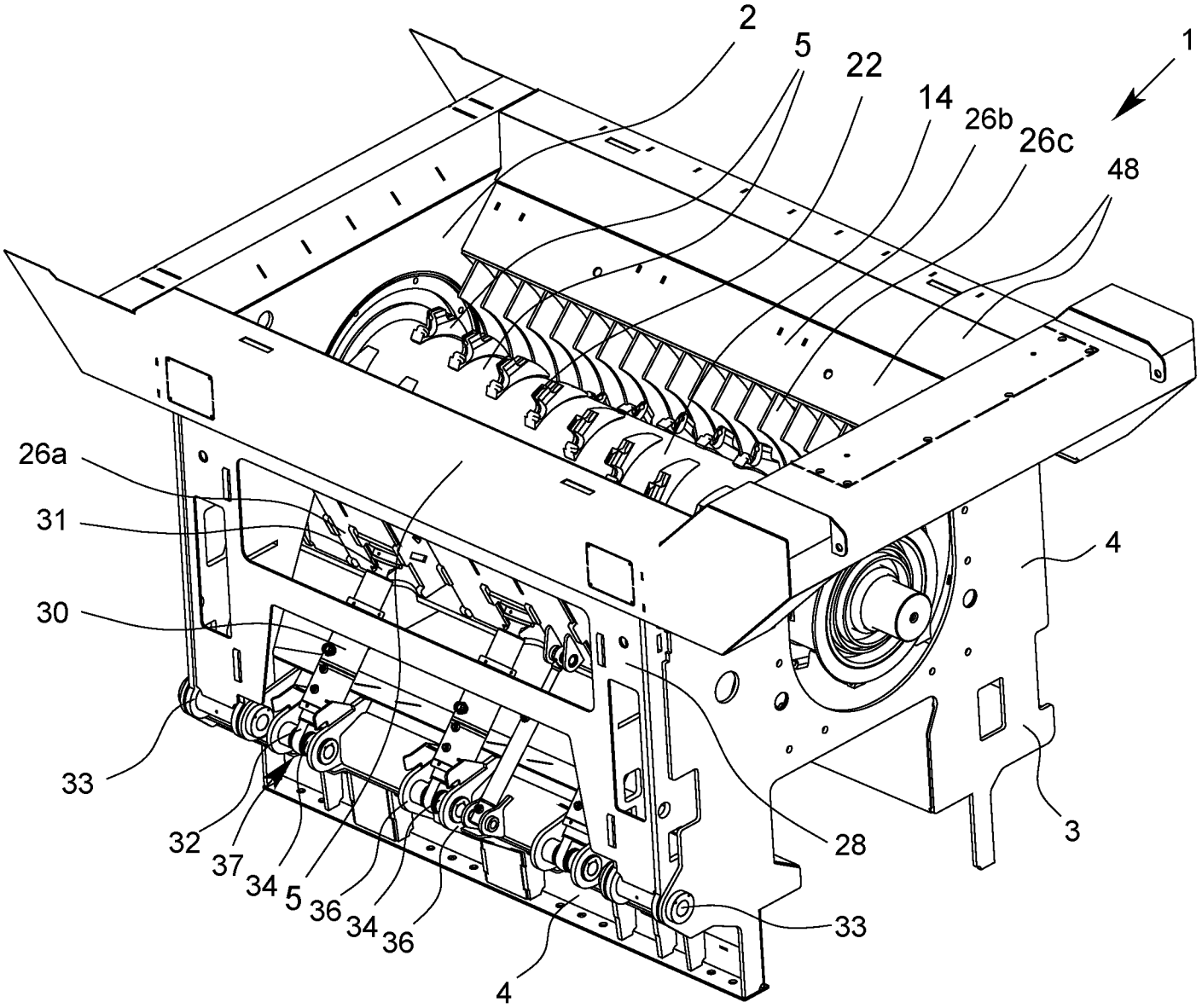

FIG. 1 shows that the comminution roller 5 is mounted on both sides, wherein its first end face 9 is connected by means of gears to the gearbox connection 7 of the gearbox 8 and wherein its second end face 15 is non-positively connected to the fastening plate 17 and thus to the second bearing wall 3 via the flange connection 16. In the example shown, the gearbox 8 is firmly connected to the first bearing wall 2, although wherein it is basically also possible to arrange the gearbox 8 separately on a ground, while the gearbox connection 7 then only projects through the first opening 6 of the first end face 9.

FIG. 1 also shows a comminution roller 5, which has a plurality of comminution tools 22. The comminution tools 22 can be designed as knives and/or teeth. In addition, FIG. 1 shows that the comminution apparatus 1 has a roller flap 26*b* arranged on the machine frame 4. The roller flap 26*b* has ribs 26*c* which have free spaces for the comminution tools 22 to pass through. It is not shown that the roller flap 26*b* is designed to be pivotable.

Figure 2:
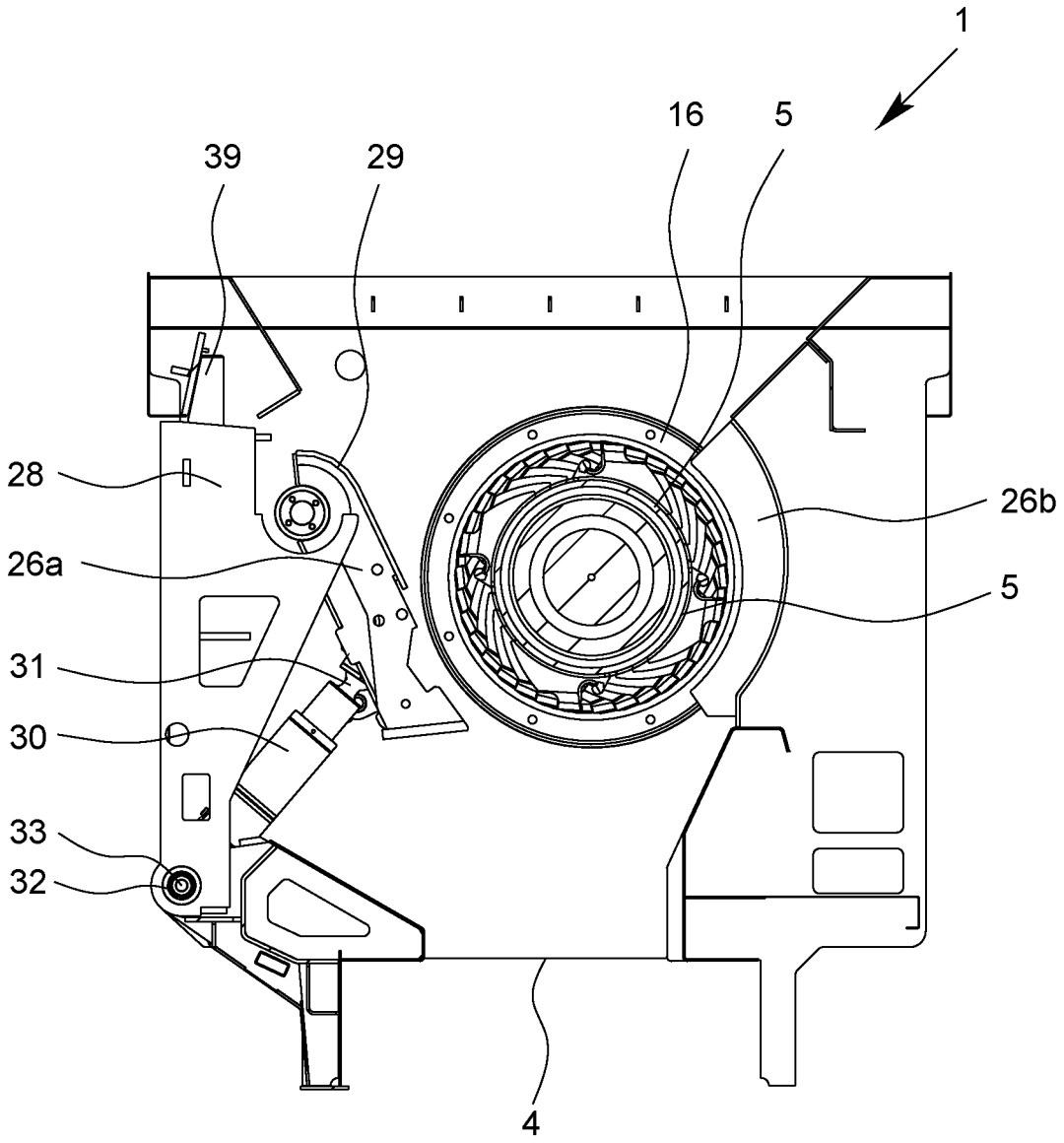
Figure 3:
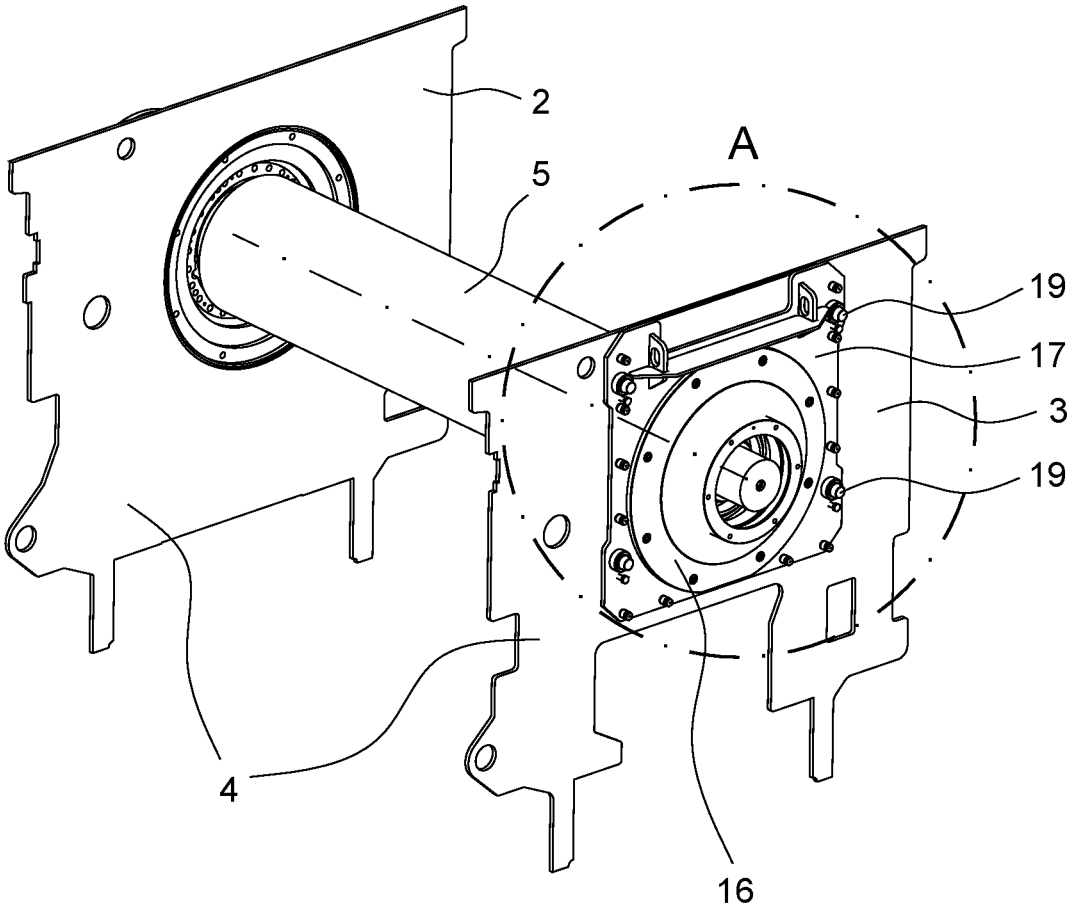

FIGS. 1 and 2 further show that the comminution apparatus 1 has a comb 26*a* arranged on the machine frame 4, wherein the comb 26*a* has counter tools 27 corresponding to the comminution tools 22 of the comminution roller 5. The interaction of the comb 26*a* with the comminution roller 5 results in comminution of the feed material during operation when the comminution roller 5 is driven via the gearbox 8 by means of a motor coupled thereto. The comb 26*a* is arranged on a pivotably mounted comb flap 28. The comb flap 28 is mounted on the machine frame 4.

Figure 11:
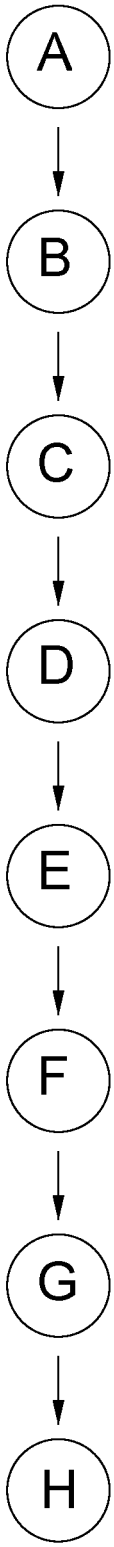
Figure 12:
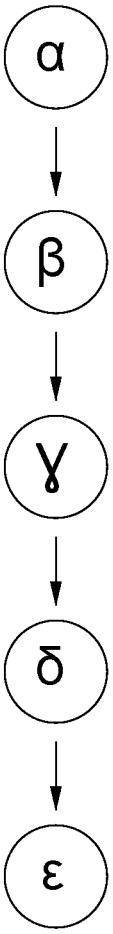
Figure 14:
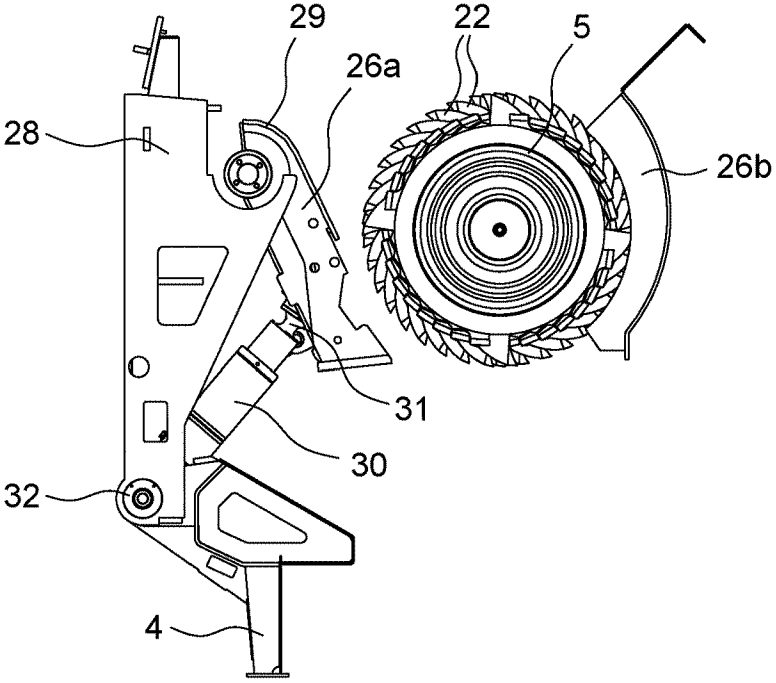

FIGS. 11 and 12 show the individual process steps for mounting and/or dismounting a comminution roller 5 of a comminution apparatus 1 of the aforementioned type. FIG. 11 shows the dismantling procedure. In step A the lifting belts are first applied to the comminution roller 5. It is not shown that at least two lifting belts are required for lifting out.

If the roller flap 26*b* has ribs 26*c*, it is provided in step A that the roller flap 26*b* is pivoted open after and/or before the lifting belts are attached to the comminution roller 5. In a further process design it is provided that the comb flap 28 has been pivoted to increase the distance between the comb 26*a* and the comminution roller 5. It is not shown that in a further embodiment it is provided that the comb 26*a* is brought as close as possible to the comb flap 28 before the connection 7 by means of gears is released.

In step B the screws and/or screw connections 23 are loosened. The jacking screws are then screwed into the threaded holes of the fastening plate 17 and/or the flange connection 16 in step C. As an alternative and/or supplement, the use of hydraulic actuators is provided for in step B. In step D, the connection by means of gears between the connection 7 of the gearbox 8 and the comminution roller 5 is loosened in a horizontal and/or axial movement. The individual jacking screws are only screwed in one by one so that the connection by means of gears is loosened as evenly as possible without tilting. During this initial axial release movement, the comminution roller 5 is fixed by centering means 19.

After loosening the connection by means of gears, accompanied by a given movement in axial direction, the comminution roller 5 is moved out of the second opening 10 of the second bearing wall 3 in a radial movement in step E through the opening range 12 which is opened outwards. Depending on the arrangement and course of the opening range 12, this movement can take place upwards and/or laterally and/or downwards.

Preferably, the lifting straps are not moved during the release of the connection by means of gears and the axial movement in step E. After the entire comminution roller 5, in particular including the fastening plate 17, has been released from the comminution apparatus 1, the comminution roller 5 is discarded. It is advantageous that the depositing in step H occurs onto the flattened range 21 of the fastening plate 17, wherein the flattened range 21 is arranged on a ground.

To prevent the comminution roller, in particular with its end opposite the fastening plate 17, from resting on the ground, it is arranged at this end on and/or placed on a bearing block 25. The bearing block 25 has at least substantially the same hub height as the comminution roller 5 and adapts to the bearing height of the fastening plate 17. The bearing block 25 can also be designed in such a way that it enables a connection by means of gears with the comminution roller 5. The bearing block can then have a corresponding shaft journal for this purpose. Such a bearing block 25 makes it possible to turn the comminution roller 5 for repair purposes.

In a design example not shown, the bearing block 25 is connected to a turning apparatus which, in another embodiment, has a power-driven drive. The turning apparatus is designed in such a way that it can turn the comminution roller 5, in particular wherein the shaft journal is connected to the comminution roller 5 in a suitable manner.

The comminution tools 22 of the comminution roller 5 can be changed in the dismantled state from the comminution apparatus 1 to the comminution roller 5 by rotating the comminution roller 5 in step G, which is preferably supported on the fastening plate 17 and on the bearing block 25. After turning the comminution roller 5, the comminution tools 22, which are particularly damaged, can be replaced.

To mount the comminution roller 5 in the comminution apparatus 1, an analogous procedure is provided in comparison to dismantling, wherein the procedure steps shown in FIG. 11 are carried out backwards. FIG. 12 shows the process sequence for mounting a comminution roller 5. First, the lifting straps are arranged on the comminution roller 5 in step α and this is released from the bearing block 25. In a lifting movement, preferably without moving the lifting tools and/or lifting belts, the comminution roller 5 is moved into the comminution apparatus 1 through the opening range 12 from above and/or below and/or laterally into the second opening 10. At least towards the end, this is a radial movement. In this condition, the centering roller 5 is not yet connected to the gearbox 8 or to the second bearing wall 3. If the roller flap 26*b* has ribs 26*c*, it must be pivoted to the gearbox connection 7 after arrangement of the first end face 9 of the comminution roller 5. In a further process design, it is planned that the comb flap 28 is shut to the gearbox connection 7 after the first end face 9 of the comminution roller 5 has been arranged. It is not shown that for a further embodiment it is intended that the comb 26*a* is brought as close as possible to the comminution roller 5 after arrangement of the comminution roller 5 to the gearbox connection 7.

In the step β the comminution roller 5 is moved in axial direction, wherein the centering means 19 engage in the respective centering openings 20.

In the step γ the gearing by means of gears between the gearbox connection 7 of a gearbox 8 and the comminution roller 5, especially on the drive side in the range of its first end face 9, is made. The arrangement on the gearbox connection 7 of the comminution roller 5 is established in a horizontal and/or axial movement, wherein the comminution roller 5 is already centered in the range of the second bearing wall 3 via the centering means 19.

The connection by means of gears is made in step δ after the comminution roller 5 has already been arranged at the gearbox connection 7 by the horizontal movement in step γ.

A fixed arrangement and/or the final fastening of the comminution roller 5 to the comminution apparatus 1, in particular to the first bearing wall 2 and the second bearing wall 3 opposite to the first bearing wall 2, is carried out in step ε, wherein all screw connections are tightened and a check is made of the function of the comminution roller 5 and of the safe connection by means of gears between the gearbox connection 7 and the comminution roller 5.

Figure 10:
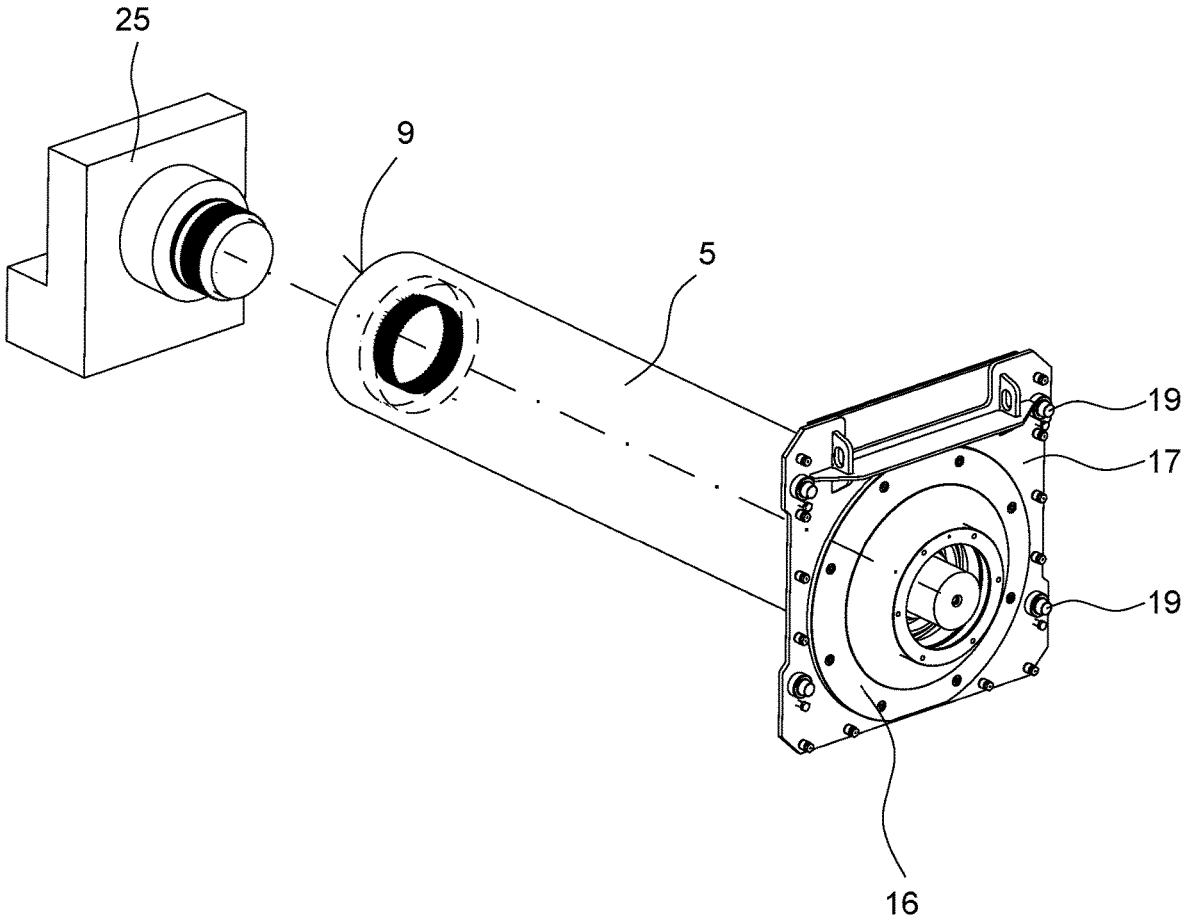

FIG. 10 shows the comminution roller 5 dismantled from the comminution apparatus 1, wherein the first end 9 of the comminution roller 5 is arranged on a bearing block 25. FIG. 10 further shows that the bearing block 25 engages in the internal toothing of the comminution roller 5. The fastening plate 17 is arranged over a flattened range 21 on a ground. The comminution tools 22 of the comminution roller 5 do not rest on the ground.

Furthermore FIG. 1 shows a comminution apparatus 1 for comminution of material to be comminuted, with a machine frame 4, a driven comminution roller 5 mounted on the machine frame 4 and having comminution tools 22, a comb 26*a* having counter tools 27 and a comb flap 28 pivotably mounted on the machine frame 4, wherein the comminution roller 5 cooperates with the comb 26*a* for comminution, wherein the comb 26*a* is pivotably mounted on the comb flap 28 in the range of its upper end 29, wherein at least one spring means 30 engages the comb 26*a* with its first end 31 and wherein the comb 26*a* is resiliently supported via the spring means 30.

In FIGS. 1 and 2, the spring means is arranged with its first end face 9 on the comb 26*a*. In other embodiments not shown, the first end 31 of the spring means 30 can also be provided only in the end range of the spring means 30 and not necessarily on the end face of the spring means 30. Furthermore FIG. 1 shows that the spring center 30 is supported with its second end 32 on the machine frame 4. Ultimately, it shall be understood that in other embodiments the second end 32 of the spring means 30 does not have to be provided at the end range 31 at the end face of the spring means 30. The comb 26*a* is pivotably mounted via the spring means 30 and is supported directly on the machine frame 4. The axis around which the comb 26*a* can pivot is provided in the range of its upper end 29, since the comb 26*a* is pivotably mounted in the range of its upper end 29 on the comb flap 28.

FIG. 1 also shows that the material feed hopper 48 is arranged on the machine frame 4. In other embodiments not shown, the material feed hopper 48 is arranged above the comminution apparatus 1 and is not connected to the machine frame 4.

Figure 15:
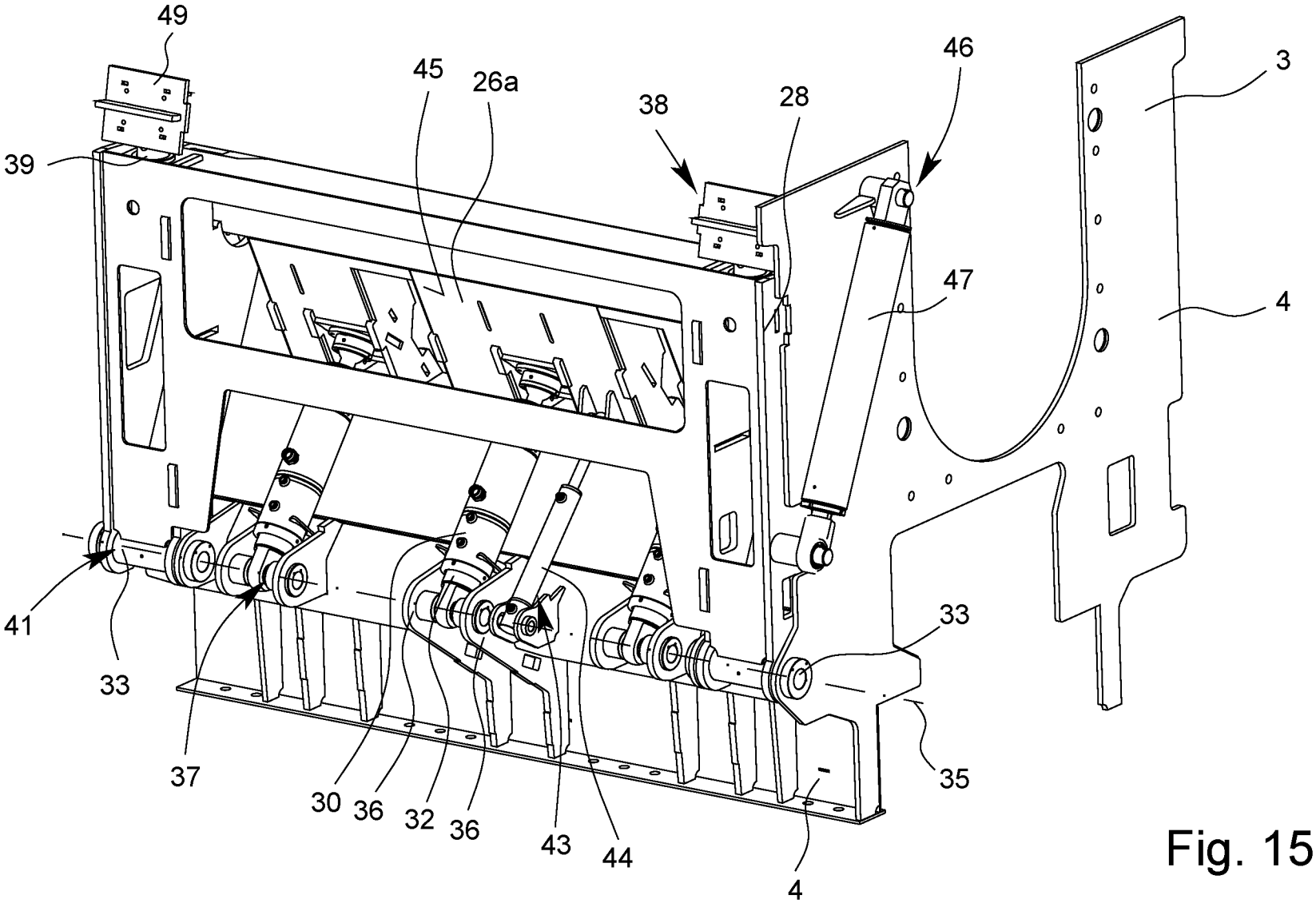
Figure 16:
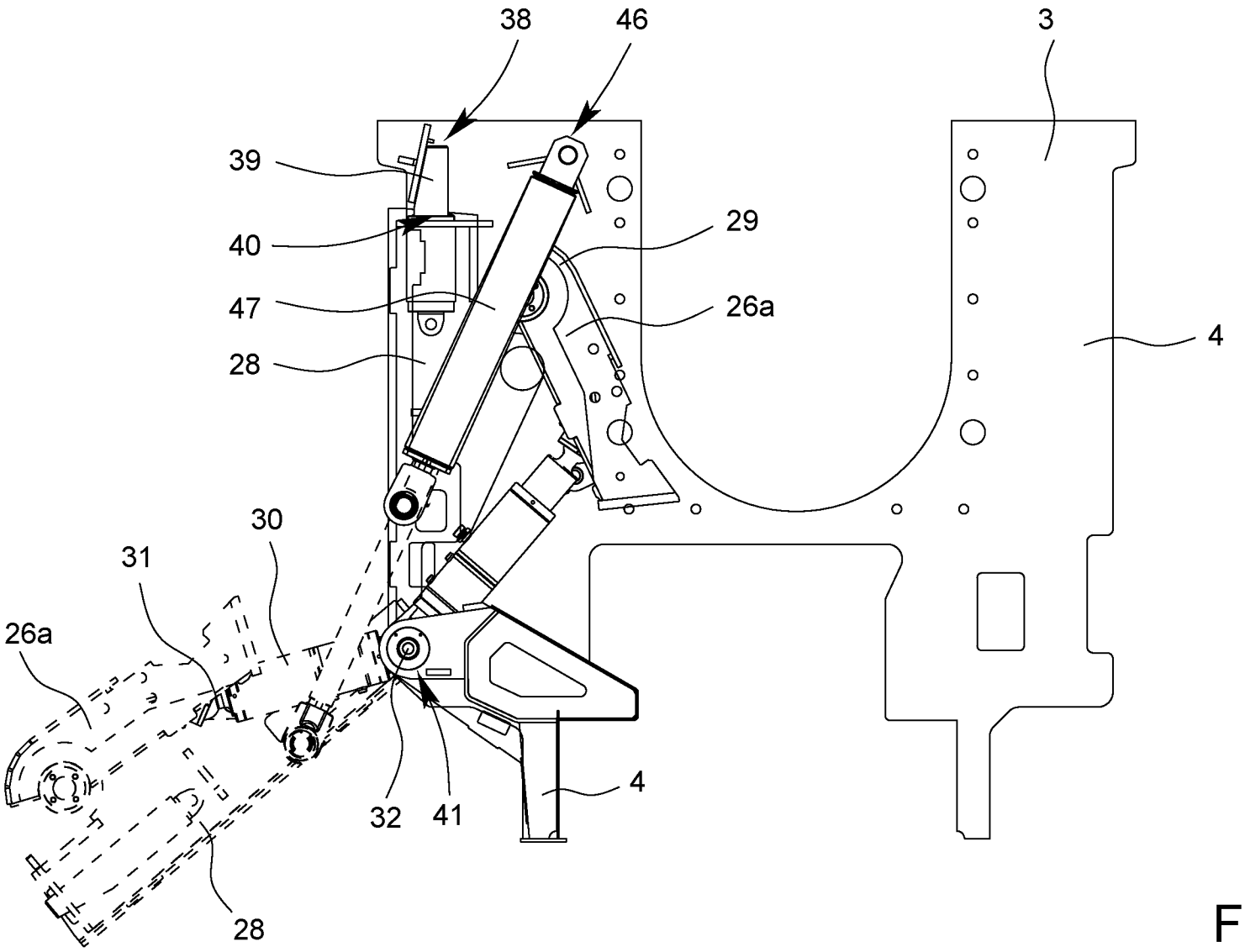
Figure 18:
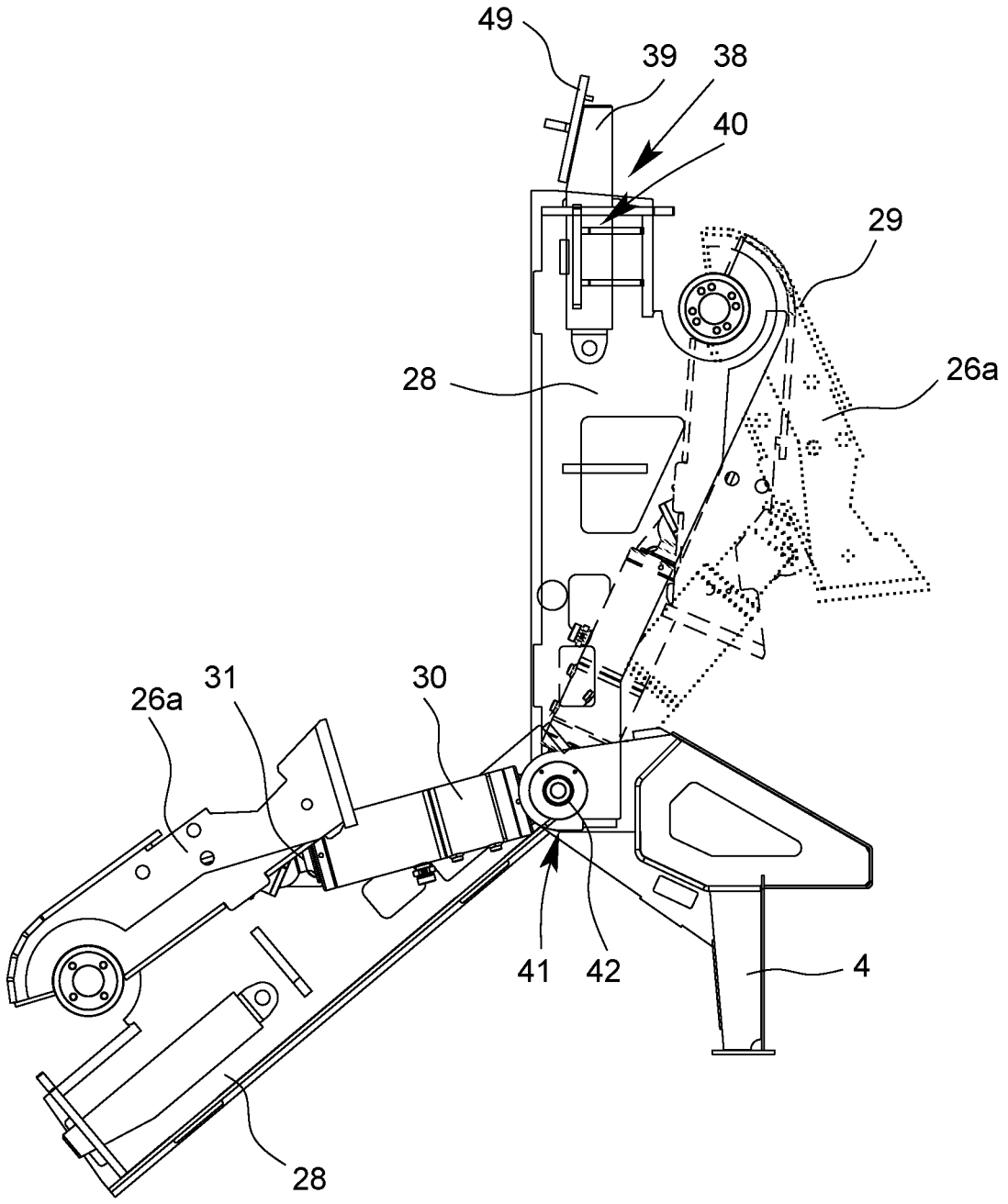

FIG. 15 shows parts and/or components of the machine frame 4 as well as the comb flap 28, the comb 26*a* and the spring means 30. FIG. 15 shows that the hinge center points 33 of the comb flap 28, around which the comb flap 28 is pivotable, and the hinge point 34 of the spring means 30 at its second end 32 lie on the same kinematic axis 35. When pivoting the comb flap 28, as shown in FIGS. 16 and 18, there is no change in position of the second end 32 of the spring means 30, as the second end 32 is arranged on the kinematic axis 35. In other versions not shown, the second end 32 is arranged on the machine frame 4, but is not located on the kinematic axis 35.

Figure 17:
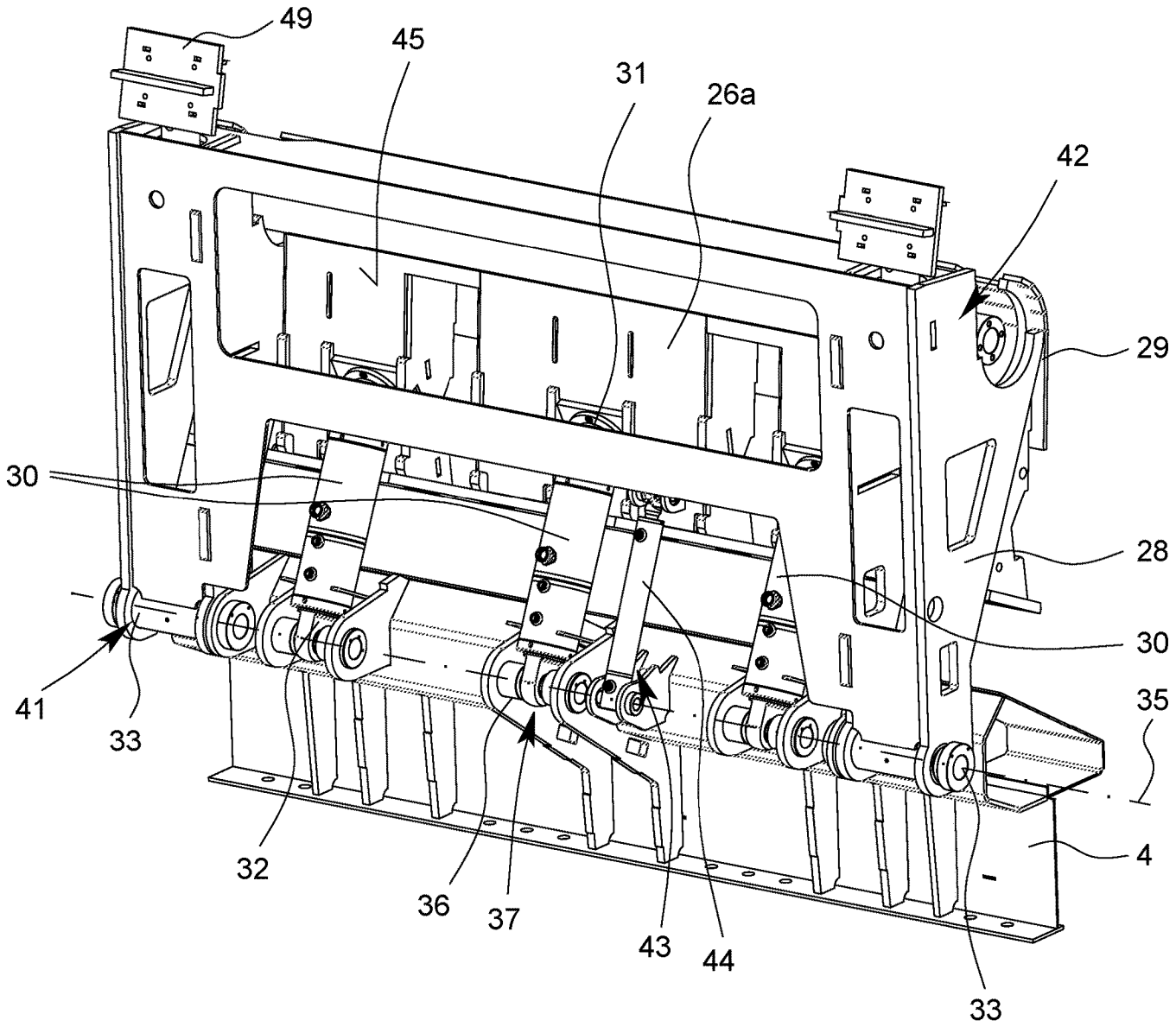

FIG. 17 also shows that bearing brackets 36 are provided on the machine frame 4. The bearing brackets 36 have bearing openings 37. The comb flap 28 and the spring means 30 are connected to the bearing brackets 36 in the range of the bearing openings 37. Appropriate bearing journals are provided for this purpose, which engage in the bearing openings 37. The centers of the bearing openings 37 lie on the kinematic axis 35. In addition, FIG. 17 shows that both the comb flap 28 and the spring means 30 are designed in their end range in such a way that both the spring means 30 and the comb flap 28 are firmly connected to the machine frame 4 via the bearing brackets 36. The reaction forces from the working process, i.e. from the comminution of the feed material, are introduced by the comb 26*a* via the spring means 30 and the bearing brackets 36 into the machine frame 4.

In all the embodiments shown, the comb 26*a* extends at least substantially over the width of the comb flap 28. The spring means 30 engage the rear 45 of the comb 26*a* with their first end 31. The comb 26*a* can also be made up of several parts in other embodiments which are not shown.

Figure 19:
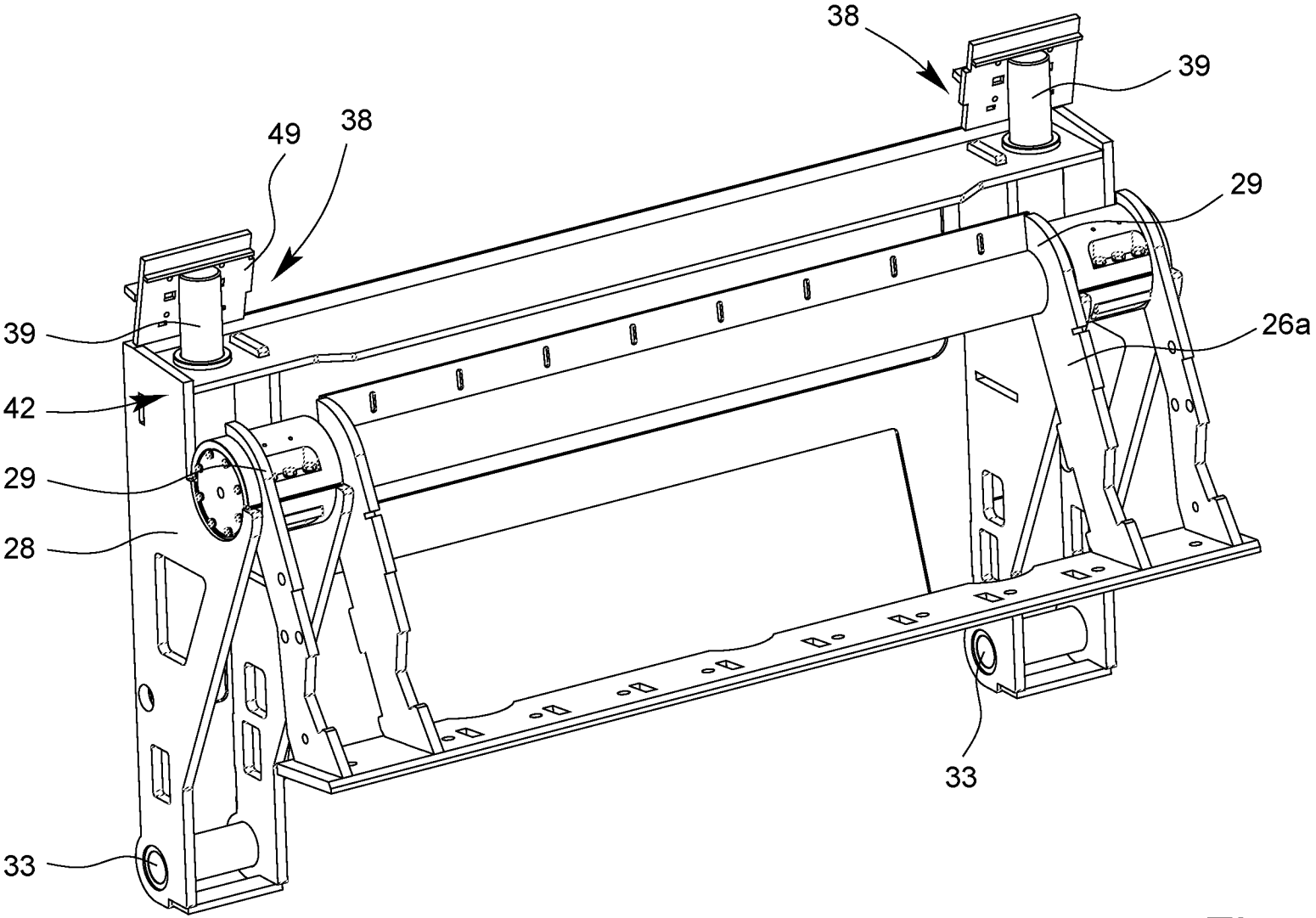

FIG. 19 shows the pivotably mounted comb 26*a* and the comb flap 28, wherein the rear 45 for the arrangement of the spring means 30 is missing in the illustration.

The pivoting and/or the pivoting open of the comb flap 28 takes place around the kinematic axis 35 in the lower range of the comb flap 28, as shown in FIG. 18.

At least one locking device 38 is provided to lock the comb flap 28 in the closed position and thus to firmly connect the comb flap 28 to the machine frame 4. FIG. 18 shows that the locking device 38 is effective between the comb flap 28 and the machine frame 4. The locking device 38 firmly connects the comb flap 28 with the machine frame 4, wherein only after unlocking the locking device 38 is it possible to open and/or pivot open the comb flap 28, as shown in FIGS. 16 and 18. The locking device 38 has locking bolts 39. The locking bolts 39 are arranged on the side of the comb flap 28 opposite the pivot bearing 41 of the comb flap 28.

Figure 13:
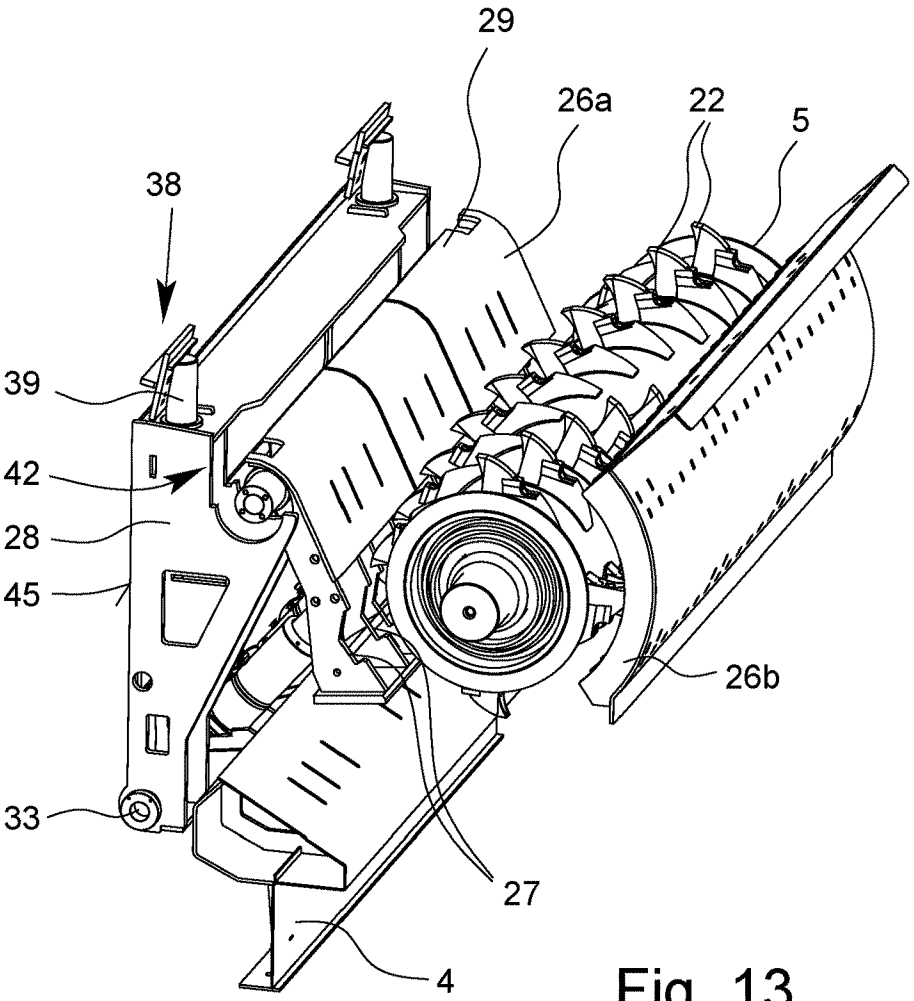

The comb flap 28 is pivoted around the pivot bearing 41 of the comb flap 28 and/or around the kinematic axis 35. The opposite side of the comb flap 28 performs an at least substantially circular pivoting movement during the pivoting process. To fix the closed state of the comb flap 28, the side of the comb flap 28 opposite the pivot bearing 41 is locked. As shown in FIG. 18, the locking bolts 39 are wedge-shaped and/or cylindrical and arranged on the comb flap 28. For locking, the locking journals 39 engage in the locking openings 40 of the machine frame 4. To release and/or open the locking device 38, the locking bolts 39 are moved out of the locking openings 40 of the machine frame 4 so that the comb flap 28 is no longer locked to the machine frame 4. In the closed position of the comb flap 28 the locking bolt 39 is fastened and/or held in its end position by an additional fastening means 49. To unlock the locking device 38, the locking bolt 39 must therefore not only be moved out of the locking opening 40 of the machine frame 4, but the fastening means 49 must also be released from the locking bolts 39. FIG. 13 shows that the comminution apparatus 1 has at least two locking devices 38 which are arranged at least substantially in the side edge range of the comb flap 28.

Even when the comb flap 28 is closed, the comb 26*a* can be pivoted, wherein the distance to the comminution roller 5 is changed by changing the position of the comb 26*a* and/or the pivot angle of the comb 26*a*. FIG. 13 illustrates that the comb 26*a* is designed as a comb beam swing arm mounted at least in the range of its two ends. The comb beam swing arm is supported on the rear 45 of the comb 26*a* by the spring means 30 on the machine frame 4. As previously mentioned, the comb 26*a* in the embodiment shown extends at least substantially over the entire width of the comb flap 28 and is pivotably mounted in the side edge range of the comb flap 28. As can be seen from FIGS. 13 and 17, the comb 26*a* is supported in its end ranges, in particular near its end faces, by the comb flap 28 and is pivotably mounted on the upper range 42 of the comb flap 28. In this range, the comb flap 28 must also absorb part of the reaction forces and part of the load of the weight of the comb 26*a*. The occurring forces are introduced into the machine frame 4 via the locking device 38. In the range of the locking device 38, the comb flap 28 supports the comb 26*a* to the machine frame 4 for short path lengths. The comb 26*a* is mounted in the upper range 42 of the comb flap 28 and the pivot bearing points of the comb 26*a* are arranged adjacent to the locking bolts 39. In other embodiments the locking bolts 39 are arranged from 1 cm to 40 cm adjacent to the pivot bearing points of the comb 26*a*.

To ensure the aforementioned pivoting movement of the comb 26*a*, the spring means 30 is designed in such a way that it enables a pivoting movement of more than 2 cm. In other embodiments, the comb 26*a* can perform a deflective movement of up to 40 cm. It is not shown that in other embodiments the distance between the comminution roller 5 and the comb 26*a* is between 2 cm and 20 cm. The pivoting movement increases the distance between the comminution roller 5 and the comb 26*a* as shown in FIG. 2. This pivoting movement of the comb 26*a* usually takes place in the event of an overload, wherein comminution of material to be comminuted that is too large or cannot be comminuted easily gets into the gap between the comminution roller 5 and the comb 26*a* and an alternative movement of the comb 26*a* nevertheless makes it possible to convey this feed material away.

As shown in FIG. 5, the spring means 30 is designed as a hydraulic cylinder. In other embodiments the spring means 30 can also be the pressure retaining cylinder. The spring means 30 is designed in such a way that it causes the comb beam swing arm to pivot in a force-controlled manner and/or enables an deflection movement of the comb 26*a* in the event of overload. In other embodiments, the spring means 30 also has a pre-pressure accumulator. The spring means 30 support the comb 26*a* and transfer the reaction forces resulting from the comminution of the material to be comminuted and the interaction between the comminution tools 22 of the comminution roller 5 and the counter tools 27 of the comb 26*a* into the machine frame 4.

FIGS. 15 and 17 show that at the lateral edge of comb 26*a* a spring means 30 engages the rear of comb 26*a* 45 with its first end 31. Furthermore FIG. 15 shows that the spring means 30, which acts on the lateral edge range of the comb 26*a*, does not have to be arranged directly on the edge of the comb 26*a*, but is located in the edge range of the comb 26*a*. Between the two lateral spring means 30 another spring means 30 is arranged in the central range of the comb 26*a* at its rear 45, wherein the further spring means 30 engages the rear 45 of the comb 26*a* with its first end 31. In further embodiments more than one spring means 30 can be arranged in the respective lateral edge ranges of the comb 26*a* and/or also additional spring means 30 in the central range of the comb 26*a*. Both the outer spring means 30 and the other central spring means 30 absorb the reaction forces of the comminution process and the weight force of the comb 26*a* and transfer these forces into the machine frame 4.

In the version shown, a device 43 is provided for setting and/or controlling and/or regulating the pivot angle of the comb 26*a*. In other embodiments not shown, a device 43 is provided for measuring and/or controlling the comb movement. The device 43 is coupled with the spring means 30 in the illustrated design example, wherein the device 43 is designed in such a way that it cannot only adjust the pivot angle of the comb 26*a* via the spring means 30, but can also regulate it according to the measured pivot angle.

FIG. 15 shows that the device 43 has a displacement measuring means 44. Displacement measuring means 44 is designed as a cylinder. Displacement measuring means 44 is designed in such a way that it can measure the pivot angle of the comb 26*a* and transfers this measured value to the device 43 both for storing the measured value and for controlling the pivot angle of the comb 26*a*. If the comminution roller 5 is fixed to the machine frame 4, the distance between the comminution roller 5 and the comb 26*a* can be deduced from the distance between the comb 26*a* and the machine frame 4 and/or, if the pivot angle of the comb 26*a* is known, from the distance between the comminution roller 5 and the comb 26*a*. FIG. 15 also shows that one end of the displacement measuring means 44 engages the rear 45 of the comb 26*a* and the other end engages the machine frame 4. The point of attack and/or the linkage point of the displacement measuring means 44 on the machine frame 4 is provided on and/or onto the kinematic axis 35. When the comb flap 28 pivots, the position of the displacement measuring means 44 relative to the comb flap 28 does not change accordingly.

It is not shown that the displacement measuring means 44 measures and records the movement of the comb 26*a*. Using this measured value, the device 43 can set the end position and/or the pivot angle of the comb 26*a* using the spring means 30.

FIGS. 16 and 18 illustrate how the comb flap 28 pivots open. An opening device 46 is used to open the comb flap 28. The opening device 46 is effective between the machine frame 4 and the comb flap 28. The opening device 46 can only be used when the locking device 38 is unlocked and/or the locking bolt 39 has been moved out of the locking opening 40 of the machine frame 4. The opening device 46 has at least one hydraulic cylinder 47, one end of which is attached to the machine frame 4 and the other end to a longitudinal edge side of the comb flap 28. On the machine frame 4, the hydraulic cylinder 47 is attached to a lateral second bearing wall 3. The hydraulic cylinder 47 can be extended so that the comb flap 28 can rotate around its pivot bearing 41 and/or the kinematic axis 35. The end of the hydraulic cylinder 47, which is arranged on the machine frame 4, is arranged at the level of the fastening means 49 and/or at the level of the locking device 38.

FIG. 18 illustrates the procedure for opening the comminution apparatus 1 and/or the individual positions of the comb 26*a* and the comb flap 28 during the pivoting movement of the comb flap 28. When the comb flap 28 is closed, the comb 26*a* is arranged at a pivoting angle to the comminution roller 5 in such a way that the counter tools 27 correspond to the comminution tools 22 so that the feed material can be comminuted. When the comb flap 28 is closed, the locking bolts 39 are retracted into the locking openings 40 of the machine frame 4. A fastening means 49 additionally fixes the locking bolt 39 in its end position. To open and/or pivot open the comb flap 28, first move the comb 26*a* as close as possible to the comb flap 28 using the spring means 30. Next the locking bolt 39 is moved out of the locking opening 40 so that the opening device 46 can be used. To open and/or pivot open the comb flap 28, the hydraulic cylinder 47 of the opening device 46 extends and thus enables access to the comb 26*a* of the comminution apparatus 1 and/or to the counter tools 27 of the comb 26*a*. Since both the spring means 30 and the pivot hinges and/or the hinge center points 33 of the comb flap 28 and the displacement measuring means 44 are arranged on the same axis, namely the kinematic axis 35, there is also no change in position of the spring means 30 and/or the displacement measuring means 44 relative to the comb flap 28 during pivoting.

REFERENCE LIST

1 Comminution apparatus
2 First bearing wall
3 Second bearing wall/lateral bearing wall
4 Machine frame
5 Comminution roller
6 first opening
7 Gearbox connection
8 Gearbox
9 First end face
10 Second opening
11 Edge
12 Opening range
13 Opening width
14 Roller body
15 second end face
16 Flange connection
17 Fastening plate
18 Fastening means
19 Centering means
20 Centering openings
21 Flattened range
22 Comminution tools
23 Screw connections
24 Screw connections
25 Bearing block
26*a* Comb
26*b* Roller flap
26*c* ribs
27 Counter tools
28 Comb flap
29 upper end of the comb
30 Spring means
31 first end spring means
32 second end spring means
33 Hinge center points comb flap
34 Hinge point Spring means
35 Kinematic axis
36 bearing brackets
37 Bearing openings
38 Locking device
39 Locking bolt
40 Locking openings
41 Pivot bearing for comb flap
42 upper range comb flap
43 Device
44 Displacement measuring means
45 Rear of the comb
46 Opening device
47 Hydraulic cylinder of the opening device
48 Material feed hopper
49 Fastening means

The invention claimed is:

1. A comminution apparatus for comminution of material to be comminuted, comprising:

a machine frame, a driven comminution roller which is mounted on the machine frame and comprises comminution tools, a comb comprising counter tools and a comb flap pivotably mounted on the machine frame, wherein the comminution roller cooperates with the comb for comminution, wherein the comb is pivotably mounted on the comb flap on the comb flap's upper end, wherein at least one spring engages the comb with a first end and wherein the comb is resiliently supported via the spring, wherein the spring is supported by a second end on the machine frame.

2. The comminution apparatus according to claim 1, wherein a hinge center point of the comb flap and a hinge point of the spring at the spring's second end lie on a same kinematic axis.

3. The comminution apparatus according to claim 1, wherein bearing brackets with bearing openings for the comb flap and the spring are provided on the machine frame and centers of the bearing openings lie on a kinematic axis.

4. The comminution apparatus according to claim 1, wherein at least one locking device is provided which acts between the comb flap and the machine frame for locking the comb flap in a closed state of the comb flap, wherein the locking device includes wedge-shaped locking bolts formed on the comb flap for engagement in locking openings on the machine frame and the locking bolts are provided on a side of the comb flap opposite pivot bearing of the comb flap.

5. The comminution apparatus according to claim 1, wherein the comb is constructed as a comb beam swing arm mounted at two end portion and/or the comb extends over the width of the comb flap and is pivotably mounted at a side edge portion of the comb flap.

6. The comminution apparatus according to claim 1, wherein the spring means, is a hydraulic cylinder and/or a pressure holding cylinder, and is configured to permit a pivoting movement of the comb to increase a distance between the comminution roller and the comb, of more than 2 cm in an overload event.

7. The comminution apparatus according to claim 1, wherein the spring engages with the first end at a rear side edge portion of the comb, wherein a further spring engages with a first end at a rear of a central portion of the comb.

8. The comminution apparatus according to claim 1, wherein a device to one or more of measure, regulate of control a pivot angle of the comb is provided.

9. The comminution apparatus according to claim 1, wherein the device has a displacement measuring means, wherein the displacement measuring means engages with a first end on a rear side of the comb and with a second end on the machine frame.

10. The comminution apparatus according to claim 1, wherein the device is coupled with the at least one spring.

11. The comminution apparatus according to claim 1, wherein an opening device is provided between the machine frame and the comb flap for pivoting the comb flap, wherein the opening device has at least one hydraulic cylinder, one end of which is attached to the machine frame, and the other end of which is attached to a longitudinal edge side of the comb flap.

12. A comminution apparatus comprising:

a machine frame, a driven comminution roller, the driven comminution roller mounted on the machine frame, the driven comminution roller including a plurality of comminution tools, a comb flap pivotably mounted at a first end on the machine frame, a comb comprising counter tools located on an opposite end of the comb flap, and at least one spring with a first end attached to the comb and a second end attached to the machine frame.

13. The apparatus of claim 12, wherein the at least one spring supports the comb.

14. The apparatus of claim 12, further comprising at least one locking mechanism between the comb flap and the machine frame to lock the comb flap in a closed state.

15. The apparatus of claim 12, a device to one or more of measure, regulate or control a pivot angle of the comb.

16. The apparatus of claim 12, further comprising an opening apparatus between the machine frame and the comb flap to allow pivoting of the comb flap.

17. A comminution apparatus comprising:

a machine frame, a comminution roller mounted in two bearing walls of the machine frame, the comminution roller including a plurality of comminution tools, a comb flap extending between the two bearing walls and pivotably mounted at a first end on the machine frame, a comb comprising counter tools pivotably mounted on an opposite end of the comb flap, and at least one spring with a first end attached to the comb and a second end attached to the machine frame.

18. The apparatus of claim 17, wherein the at least one spring supports the comb.

19. The apparatus of claim 17, further comprising at least one locking mechanism to lock the comb flap in a closed state.

20. The apparatus of claim 17, wherein the comb flap pivots to an open state.

* * * * *